US005250407A

United States Patent [19]

Kase

[11] Patent Number: 5,250,407

[45] Date of Patent: Oct. 5, 1993

[54] SILVER HALIDE COLOR PHOTOGRAPHIC LIGHT-SENSITIVE MATERIAL CONTAINING AT LEAST ONE 5-PYRAZOLONE COUPLER AND AT LEAST ONE MONODISPERSE CUBIC SILVER HALIDE EMULSION

[75] Inventor: Akira Kase, Kanagawa, Japan

[73] Assignee: Fuji Photo Film Co., Ltd., Kanagawa, Japan

[21] Appl. No.: 834,981

[22] Filed: Feb. 14, 1992

Related U.S. Application Data

[63] Continuation of Ser. No. 386,762, Jul. 31, 1989, abandoned.

[30] Foreign Application Priority Data

Aug. 3, 1988 [JP] Japan ..... 63-193672

[51] Int. Cl.[5] ..... G03C 7/384; G03C 1/09

[52] U.S. Cl. ..... 430/5.55; 430/567; 430/569; 430/605

[58] Field of Search ..... 430/567, 569, 604, 605, 430/555

[56] References Cited

U.S. PATENT DOCUMENTS

| | | | |
|---|---|---|---|
| 3,854,949 | 12/1974 | Gilman, Jr. et al. | 430/567 |
| 4,248,962 | 2/1981 | Lau | 430/382 |
| 4,269,927 | 5/1981 | Atwell | 430/604 |
| 4,741,994 | 5/1988 | Ichijima et al. | 430/549 |
| 4,746,603 | 5/1988 | Yamashita et al. | 430/605 |
| 4,842,994 | 7/1989 | Sakanoue et al. | 430/543 |
| 4,853,319 | 8/1989 | Krishnamurthy et al. | 430/505 |
| 4,876,182 | 10/1989 | Buckland | 430/957 |
| 4,897,342 | 1/1990 | Kajiwara et al. | 430/605 |
| 4,900,657 | 2/1990 | Crawley et al. | 430/555 |
| 4,929,540 | 5/1990 | Furutuchi et al. | 430/555 |

FOREIGN PATENT DOCUMENTS 0194452 10/1985 Japan .

*Primary Examiner*—Lee C. Wright

*Attorney, Agent, or Firm*—Birch, Stewart, Kolasch & Birch

[57] ABSTRACT

A silver halide color photographic light-sensitive material, comprising at least one silver halide light-sensitive emulsion layer provided on a support wherein at least one of said light-sensitive emulsion layer contains (i) at least one 5-pyrazolone coupler having an elimination group represented by the following general formula (I) at the coupling position thereof and (ii) at least one monodisperse cubic silver halide emulsion containing at least one metal ion selected from the group consisting of ions of metals of Group VIII of the Periodic Table, transition metals of Group II of the Periodic Table, lead and thallium in an amount of from $1\times10^{-9}$ to $1\times10^{-3}$ mol per mol of silver halide, said emulsion being obtained by incorporating said metal ion into silver halide grains in the silver halide light-sensitive emulsion by adding the ion to an emulsion formation system before or during formation of the grains or after formation of the grains but before the addition of a chemical sensitizer;

(I)

14 Claims, No Drawings

SILVER HALIDE COLOR PHOTOGRAPHIC LIGHT-SENSITIVE MATERIAL CONTAINING AT LEAST ONE 5-PYRAZOLONE COUPLER AND AT LEAST ONE MONODISPERSE CUBIC SILVER HALIDE EMULSION

This application is a continuation of application Ser. No. 07/386,762 filed on Jul. 31, 1989, now abandoned.

FIELD OF THE INVENTION

The present invention relates to a silver halide color photographic light-sensitive material and an image forming method using the same. More particularly, the present invention relates to a silver halide color photographic light-sensitive material which can be rapidly processed and is excellent in processing stability.

BACKGROUND OF THE INVENTION

A color photographic material which allows the processing time to be shortened and is not affected very much by processing factors is in demand. Also, a color photographic material having excellent stability during processing and an image forming method using such a color photographic material is in demand. Moreover, a color photographic material providing a short delivery time and a reduction in labor during the processing thereof has been in demand in recent years.

Methods for shortening the processing time in each processing stage include elevating the processing temperature or increasing the replenishment amount. Further, other methods have been proposed for shortening the processing time including, for example, methods wherein stirring is vigorously conducted and methods where various accelerators are added.

There are also known methods to attain a rapid color development and a reduced replenishment, wherein color photographic materials containing an emulsion are used having a high silver chloride content called a high silver chloride emulsion are used in the place of silver chlorobromide emulsions having a high silver bromide content which have been conventionally used. For example, WO87-04534 discloses a method for rapidly processing high silver chloride type silver halide color photographic materials by using color developing solutions containing substantially no sulfite ion or benzyl alcohol.

However, when color development is carried out according to the above method, there are problems including an insufficient rate of development, poor photographic sensitivity and a tendency of fogging when the developing time is prolonged in order to provide high sensitivity, even though the above method has a development accelerating effect as compared with conventional methods.

SUMMARY OF THE INVENTION

An object of the present invention is to provide a color photographic material which can be rapidly processed, is highly sensitive and has little fog over a wide exposure range, is not affected very much by fluctuations in development conditions and has a stable quality.

The above object of the present invention has been achieved by providing (1) A silver halide color photographic light-sensitive material, comprising at least one silver halide light-sensitive emulsion layer provided on a support wherein at least one of said light-sensitive layers contains at least one 5-pyrazolone coupler having an elimination group represented by the following general formula (I) at the coupling position thereof and at least one monodisperse cubic silver halide emulsion containing at least one metal ion selected from the group consisting of ions of metals of Group VIII of the Periodic Table, transition metals of Group II of the Periodic Table, lead and thallium in an amount of from $1\times10^{-9}$ to $1\times10^{-3}$ mol per mol of silver halide, which is incorporated into silver halide grains in the silver halide light-sensitive emulsion by adding the ion to an emulsion formation system before or during formation of the grains or after formation of the grains but before the addition of a chemical sensitizer;

(2) A silver halide color photographic light-sensitive material as in the preceding item (1), wherein a dry film thickness is not more than 15 μm and a wet film thickness is from 20 μm to 40 μm; and (3) A method for forming an image of a silver halide color photograph, comprising processing the photographic material of the preceding item (1) or (2) by using a color developing solution containing chlorine ion in an amount of from $3.5\times10^{-2}$ to $1.5\times10^{-1}$ mol/l and bromine ion in an amount of from $3.0\times10^{-5}$ to $1.0\times10^{-3}$ mol/l.

The elimination group of general formula (I) is as follows:

(I)

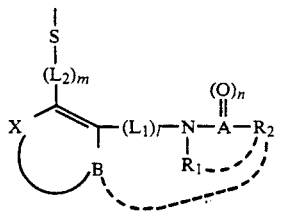

wherein $L_1$ and $L_2$ each represents a methylene group or an ethylene group; l and m each represents 0 or 1; $R^1$ represents a hydrogen atom, an alkyl group, an aryl group or a heterocyclic group; $R_2$ represents a group linked with A and is a carbon atom, an oxygen atom, a nitrogen atom or a sulfur atom; A represents a carbon atom or a sulfur atom; n represents 1 when A is a carbon atom or n represents 1 or 2 when A is a sulfur atom; B represents a carbon atom, an oxygen atom, a nitrogen atom or a sulfur atom; X represents an atomic group required for the formation of a ring; $R_1$ and $R_2$ may be combined together to form a ring; and B and $R_2$ may be combined together to form a ring when B is a carbon atom or a nitrogen atom.

DETAILED DESCRIPTION OF THE INVENTION

The present invention will be described in more detail hereinbelow.

With regard to the external form and the grain size of the silver halide emulsion of the present invention, cubic monodisperse silver halide emulsions are used.

The external forms of the silver halide grains can be observed through an electron microscope.

The cubic emulsion grains of the present invention include those in which the corners and edges of the cubes are almost round and they are apparently almost spheres. Emulsions containing quantitatively at least 50% of grains having a K value of preferably at least 7, more preferably at least 500, are used, wherein the K value is a ratio of (200) plane and (222) plane which constitute the outer surfaces of the silver halide grains.

The K value in the present invention is defined by the following formula:

$$K = \frac{\text{Intensity of diffraction line assigned to (200) plane}}{\text{Intensity of diffraction line assigned to (222) plane}}$$

The measurement of the intensity of the diffraction line in the present invention is described in, for example, *Bulletin of the Society of Scientific Photography of Japan,* Vol. 13, page 5. The intensity of the diffraction line can be determined by powder X-ray diffraction analysis of an emulsion containing silver halide grains oriented and coated on a substrate.

Preferably, the pyrazolone magenta couplers of the present invention are incorporated in monodisperse cubic silver halide emulsions containing a metal ion.

The silver halide of the present invention has a grain size of preferably not larger than 1.5 μm, more preferably not larger than 1 μm, but not smaller than 0.2 μm.

The monodisperse silver halide grains of the present invention have such a grain size distribution that the ratio ($S/\bar{r}$) of the standard deviation S to the mean grain size $\bar{r}$ is preferably not higher than 0.2, and more preferably not higher than 0.15.

The grain size distribution and the mean grain size of the silver halide grains can be determined by measuring the projected areas of the silver halide grains from the electron micrograph and processing statistically the measured values according to the method described in T. H. James, *The Theory of the Photographic Process* (1977, Macmillan), Chapter 3, from page 100. With regard to the mean grain size, the arithmetical mean is used.

In this case, it is preferred that two or more of the above monodisperse emulsions are blended in the same layer or a multi-layer coating is conducted for the purpose of obtaining a wide latitude.

It is preferred that silver chloride or silver chlorobromide containing substantially no silver iodide is used as the halogen composition of the silver halide emulsion in the present invention. The term "containing substantially no silver iodide" as used herein means that the content of silver iodide is not higher than 1 mol %, preferably not higher than 0.2 mol %. The emulsion contains grains which may have the same or different halogen compositions. However, when an emulsion containing grains having the same halogen composition is used, the properties of the grains can be easily made homogeneous. With regard to the halogen composition distribution in the interior of the grains of the silver halide emulsion, there may be used any of the uniform structure type grains wherein the halogen composition is equal throughout the silver halide grains, laminated structure type grains wherein the core of the interior of the silver halide grain is different in halogen composition from a shell surrounding the core (including a single layer type as well as multi-layer type), and grains having such a structure that there exists areas having a different halogen composition in a non-laminar form in the interior of the grains or on the surfaces of grains (when there exist said areas on the surfaces of the grains, said areas having a different halogen composition are joined at the corners, edges or planes).

Preferably, from the viewpoint of pressure resistance, either of the latter two type of structures rather than an uniform structure type is used for the purpose of imparting high sensitivity. When silver halide grains having the above-described structures are used, the boundary between areas having different halogen compositions may either be clear or unclear where a mixed crystal having difference in halogen composition is formed. Alternatively, the boundary may have a continuous change in structure.

With regard to the halogen compositions of these silver chlorobromide emulsions, the ratio of silver bromide/silver chloride may be varied widely according to the intended purpose. Preferably, high silver chloride emulsions having a high silver chloride content are used for photographic materials suitable for use in rapid processing. These high silver chloride emulsions have a silver chloride content of preferably not lower than 90 mol %, more preferably not lower than 95 mol %.

Preferably, the high silver chloride emulsions have such a structure that silver bromide-localized phases exist in a laminar or non-laminar form in the interior portions of the silver halide grains and/or on the surfaces thereof.

Moreover, it is effective to further increase the silver chloride content of the silver halide emulsions for the purpose of reducing the replenishment rates of the developing solutions. In this case, approximately pure silver chloride emulsions having a silver chloride content of 98 to 100 mol % are preferred.

The localized phases preferably have such a halogen composition that the silver bromide content is at least 10 mol %, more preferably higher than 20 mol %. The localized phases are formed in the interior portions of grains or on the edges, corners or planes of the surfaces of the grains. In a preferred embodiment, localized phases are formed on the corners of the grains by epitaxial growth.

In some cases, uniform structure type grains having a narrow halogen composition distribution are preferred for the purpose of preventing the sensitivity from being lowered when pressure is applied to the photographic materials, even when high silver chloride emulsions having a silver chloride content of not lower than 90 mol % are used.

In the present invention, if there is no specific definition of the phase "metal ion", this phase means a metal ion or a metal complex ion which can be derived from a metal salt or a metal complex salt. The metal salt or metal complex salt may be an organic or inorganic metal salt or metal complex salt.

Examples of metal ions to be incorporated in the silver halide grains of the present invention include metal ions derived from Group VIII metals of the Periodic Table such as iron, iridium, platinum, palladium, nickel, rhodium, osmium, ruthenium and cobalt; Group II transition metals such as cadmium, zinc and mercury, and other metals such as lead, thallium and complex ions. At least one member of these metal ions or complex ions is used in the present invention. When silver halide grains have the above-mentioned localized phases, it is preferred that at least one of iridium ion, rhodium ion, iron ion are mainly used for the localized phases and a combination of metal ions selected from osmium, iridium, rhodium, platinum, ruthenium, palladium, cobalt, nickel and iron or complex ions thereof are mainly used for the substrate. If desired, the localized phase and the substrate may be different in the type and concentration of the metal ions from each other. A plurality of the metal ions may be used.

Further, metal ions such as cadmium, zinc, lead, mercury and thallium ions can be used.

Now, these metal ions will be illustrated in more detail below.

Iridium ion-containing compounds are trivalent or tetravalent salts or complex salts. The complex salts are particularly preferred. Examples of the iridium ion-containing compounds include halide, amines and oxalato complex salts such as iridium(III) chloride, iridium(III) bromide, iridium (IV) chloride, sodium hexachloroiridate(III), potassium hexachloroiridate(IV), hexammineiridium(III) salt, trioxalatoiridate(III) and trioxalatoiridate(IV). These compounds are used in an amount preferably of $5\times10^{-9}$ to $1\times10^{-4}$ mol, more preferably from $5\times10^{-8}$ to $5\times10^{-6}$ mol per mol of silver.

Platinum ion-containing compounds are bivalent salts, tetravalent salts or complex salts, among which the complex salts are preferred. Examples of the platinum ion-containing compounds include platinum(IV) chloride, potassium hexachloroplatinate(IV), potassium tetrachloroplatinate(II), potassium tetrabromoplatinate(II), sodium tetrakis(thiocyanato)platinate(IV) and hexammineplatinum(IV) chloride. These compounds are used preferably in an amount of $1\times10^{-8}$ to $1\times10^{-5}$ mol per mol of silver.

Palladium ion-containing compounds are generally bivalent salts, tetravalent salts or complex salts, among which the complex salts are particularly preferred. Examples of the palladium ion-containing compounds include sodium tetrachloropalladate(II), sodium tetrachloropalladate(IV), potassium hexachloropalladate(IV), tetramminepalladium(II) chloride and potassium tetracyanopalladate(II).

Examples of nickel ion-containing compounds include nickel chloride, nickel bromide, potassium tetrachloroniccolate(II), hexamminenickel(II) chloride and sodium tetracyanoniccolate(II).

Rhodium ion-containing compounds are preferably trivalent salts or complex salts. Examples thereof include potassium hexachlororhodate, sodium hexabromorhodate and ammonium hexachlororhodate. These compounds are used preferably in an amount of $1\times10^{-8}$ to $1\times10^{-4}$ mol per mol of silver.

Iron ion-containing compounds are ferric or ferrous compounds. Iron salts or complex salts which are water-soluble at a concentration to be used, are preferred. Iron complex salts which can be easily incorporated into silver halide grains are particularly preferred. Examples thereof include hexacyanoferrates (II), hexacyanoferrates(III), ferrous thiocyanate and ferric thiocyanate. These compounds are used preferably in an amount of $5\times10^{-9}$ to $1\times10^{-3}$ mol, more preferably $1\times10^{-8}$ to $1\times10^{-4}$ mol per mol of silver in silver halide.

The above-described metal ion donating compounds can be incorporated in the silver halide grains, for example, by adding the metal ion-donating compounds to an aqueous gelatin solution acting as a dispersion medium, an aqueous solution of a halide or an aqueous solution of a silver salt, or to another aqueous solution during the course of the formation of the silver halide grains. Alternatively, fine silver halide grains already containing metal ion therein are added to a host emulsion and dissolved thereto. The metal ion-donating compounds may be incorporated in the locallized phases of silver halide grains and/or other parts (substrates).

The incorporation of the metal ion in the emulsion grains of the present invention can be carried out before, during or immediately after the formation of grains. The time when the metal ion is added, can be determined depending on the positions of the grains where the metal ion is to be located.

When the metal ion is added to the silver halide emulsion of the present invention, high sensitivity can be imparted thereto over a wide illumination intensity range. Particularly, when the photographic materials of the present invention are processed with color developing solutions containing chlorine ion in an amount of $3.5\times10^{-2}$ to $1.5\times10^{-1}$ mol/l and bromine ion in an amount of $3.0\times10^{-5}$ to $1.0\times10^{-3}$ mol/l, the materials of the present invention are characterized by low fogging and high sensitivity.

In addition to incorporation of the metal ion to the emulsion layer containing the 5-pyrazolone coupler of the present invention, the metal ion may also be added to any one of emulsion layers in the photographic material.

The silver halide emulsions of the present invention may be chemically sensitized. Examples of sensitization methods include a sulfur sensitization method using a sulfur compound capable of reacting with active gelatin or silver (e.g., thiosulfates, thioureas, mercapto compounds, rhodanines), a reduction sensitization method using a reducing material (e.g., stannous salts, amines, hydrazine derivatives, formamidine sulfinic acid, silane compounds) and a metal sensitization method using a metallic compound (e.g., gold complex salts and complex salts of Group VIII metals such as Pt, Ir, Pd, Rh and Fe). These sensitization methods may be used either alone or in a combination of two or more.

Among these chemical sensitization methods, the sulfur sensitization method and/or the gold sensitization method are/is preferred and the sulfur sensitization method alone is particularly preferred.

These sensitization methods are described in more detail in JP-A-62-215272 (page 12 the third column line 18 to the fourth column line 16) (the term "JP-A" as used herein means an "unexamined published Japanese patent application").

The silver chlorobromide emulsions of the present invention can be prepared according to the methods described in P. Glafkides, *Chemie et Physique Photographique* (Paul Montel, 1967); G. F. Duffin, *Photographic Emulsion Chemistry* (Focal Press, 1966): and V. L. Zelikan et al, *Making and Coating Photographic Emulsion* (Focal Press, 1966). Namely, any of the acid processes, the neutral processes and the ammonia processes can be used. In the stage of preparation, a soluble silver salt and a soluble halogen salt can be reacted in accordance with a single jet process, a double jet process or a combination thereof. A reverse mixing method in which grains are formed in the presence of excess silver ion can also be used. Further, a controlled double jet process can be used in which the pAg in a liquid phase where the silver halide grains are formed is kept constant. According to this method, there can be obtained a silver halide emulsion in which the crystal form is regular and the grain size is nearly uniform.

Generally, the silver halide emulsions of the present invention are spectrally sensitized.

Spectral sensitization is carried out for the purpose of imparting spectral sensitization in the desired wavelength of light to the emulsion of each layer of the photographic materials of the present invention. It is preferred that spectral sensitization is conducted by adding a dye which absorbs light in the wavelength corresponding to the desired spectral sensitivity of the invention, namely a spectral sensitizing dye. Examples of spectral sensitizing dyes which can be used are described in F. M. Harmer, *Heterocyclic Compounds-Cyanine Dyes and Related Compounds* (John Wiley & Sons, New York, London, 1964). Concrete examples thereof include compounds described in JP-62-215272 (pages 22–38).

Various compounds or precursors thereof may be added to the silver halide emulsions of the present invention for the purpose of preventing fogging from being caused during the preparation of the photographic materials, during the storage thereof or during processing, or for the purpose of stabilizing the photographic performance. These compounds are generally called photographic stabilizers. Preferred examples of these compounds are described in the aforesaid JP-A-62-215272 (pages 39–72).

The emulsions of the present invention may be any type of a surface latent image type emulsion wherein the latent image is predominantly formed on the surface of the grain, and the internal image type emulsion wherein the latent image is predominantly formed in the interior of the grain.

As described above, the photographic materials of the present invention are highly sensitive and have a low amount of fog. The characteristics of the present invention can be effectively exhibited when the sum total of the dry thickness (dried at 25° C., 55% RH for one week) of a hydrophilic coated material obtained by coating a support with the silver halide emulsion of the present invention is not more than 15 μm, the wet thickness is in the range of 20 to 40 μm and the 5-pyrazolone coupler having an elimination group represented by the general formula (I) is incorporated. It is known that it is advantageous in accelerating the development rate to have a film thickness during drying (dry thickness) which is small and to have a film thickness during wetting (wet thickness) which is large. However, when the emulsion containing the metal ion and the coupler of the present invention is used, a problem is caused wherein uneven development and stain are liable to result when the film thickness during wetting is too large. Therefore, the film thickness during wetting (wet thickness) must be kept 40 μm or below. The term "film thickness during wetting" or "wet thickness" as used herein refers to thickness after the coated material is immersed in distilled water at 35° C. for 3 minutes.

5-pyrazolone couplers having an elimination group represented by general formula (I) will be illustrated below.

In the present invention, where the acyl group, the sulfonyl group, the sulfonamido, etc., are not specifically defined, they include aliphatic and aromatic groups thereof, and where the heterocyclic group is not specifically defined it preferably a 5- to 7-membered heterocyclic group containing at least one of S, O and N atoms as a hetero atom.

$L_1$ and $L_2$ each represents a substituted or unsubstituted methylene or ethylene group. The groups which may be substituted thereon include halogen atoms (fluorine, chlorine, bromine, etc.), aliphatic groups (e.g., 1–22C straight chain or branched chain alkyl, aralkyl, alkenyl, alkynyl, cycloalkyl or cycloalkenyl), aryl groups (e.g., phenyl, naphthyl), heterocyclic groups (e.g., 2-furyl, 3-pyridyl), alkoxy groups (e.g., methoxy, ethoxy, cyclohexyloxy), aryloxy groups (e.g., phenoxy, p-methoxyphenoxy, p-methylphenoxy), alkylamino groups (e.g., ethylamino, dimethylamino), alkoxycarbonyl groups (e.g., methoxycarbonyl, ethoxycarbonyl), carbamoyl groups (e.g., N,N-dimethylcarbamoyl), anilino groups (e.g., phenylamino, N-ethylanilino), sulfamoyl groups(e.g., N,N-diethylsulfamoyl), alkylsulfonyl groups (e.g., methylsulfonyl), arylsulfonyl groups (e.g., tolylsulfonyl), alkylthio groups (e.g., methylthio, octylthio), arylthio groups (e.g., phenylthio, 1-naphthylthio), acyl groups (e.g., acetyl, benzoyl), acylamino groups (e.g., acetamido, benzamido), imido groups (e.g., succinimide, phthalimide), ureido groups (e.g., phenylureido, N,N-dibutylureido), sulfamoylamino groups (e.g., N,N-dipropylsulfamoylamino), alkoxycarbonylamino groups (e.g., methoxycarbonylamino), sulfonamido groups (e.g., methanesulfonamide), a hydroxyl group and a cyano group, etc. Preferably, $L_1$ and $L_2$ are unsubstituted methylene and ethylene groups. l and m each represents 0 or 1 and are preferably 0.

$R_1$ represents a hydrogen atom, an alkyl group, an aryl group or a heterocyclic group. In more detail, $R_1$ represents a hydrogen atom, an aliphatic group such as a 1–22C straight chain or branched chain alkyl group, alkenyl group or cycloalkyl group, an aryl group such as a phenyl or a naphthyl group or a heterocyclic group such as a 2-furyl, 2-thienyl, 2-pyrimidinyl or 4-pyridyl group. These may also have the substituent thereon that were defined for $L_1$ and $L_2$. Preferably, $R_1$ is a hydrogen atom or an alkyl group.

$R_2$ represents a group that is linked to A by a carbon, oxygen, nitrogen or sulfur atom. In more detail, $R_2$ represents a group that is linked by a carbon atom such as an alkyl group, an aryl group, a heterocyclic group (linked by a carbon atom), an acyl group, an alkoxycarbonyl group or a carbamoyl group (linked by a carbon abom); a group that is linked by an oxygen atom such as an alkoxy group or an aryloxy group; a group that is linked by a nitrogen atom such as an alkylamino, anilino, acylamino, ureido, sulfamoylamino, alkoxycarbonylamino or sulfonamido group; or a group that is linked by a sulfur atom such as an alkylthio group or an arylthio group. Like $R_1$, $R_2$ may also have the substituent thereon that were defined for $L_1$ and $L_2$. Preferably, $R_2$ is an alkyl, aryl, alkylamino or anilino group.

A represents a carbon atom or a sulfur atom and is preferably a carbon atom.

n is 1 when A is a carbon atom and is 1 or 2 when A is a sulfur atom.

B represents a carbon, oxygen, nitrogen or sulfur atom and is preferably a carbon or nitrogen atom and still more preferably a carbon atom.

X represents a group of atoms necessary for forming a ring and is preferably a group that is necessary for forming a saturated or unsaturated 5, 6 or 7 membered ring and is constituted by atoms selected from among carbon, oxygen, nitrogen and sulfur atoms. More preferably, X is a group that is needed for forming an unsaturated 5 or 6 membered ring and is constituted by atoms selected from among carbon, oxygen and nitrogen atoms. These rings may also have a substituent thereon that were defined for $L_1$ and $L_2$ and other rings may be condensed onto the ring containing X.

$R_1$ and $R_2$ may be bonded to one another and form a ring and may preferably form a 5- or 6-membered saturated or unsaturated ring. Such rings may also have the substituent thereon that was defined for $L_1$ and $L_2$.

When B is a carbon atom or a nitrogen atom, B and $R_2$ may be bonded to one another to form a ring and they may suitably form a 5- or 6-membered saturated or unsaturated ring, a 5- or 6-membered saturated ring being preferred. Such rings may also have the substituent thereon that was defined for $L_1$ and $L_2$.

A first preferred pyrazolone coupler is represented by the following general formula:

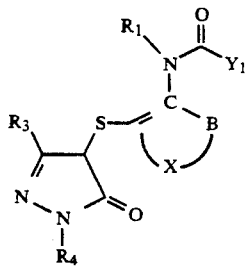

wherein $Y_1$ in this general formula represents Ra or $Z_1$Rb; Ra represents a substituted or an unsubstituted aryl or a heterocyclic group or a substituent possessing a secondary or tertiary group represented by

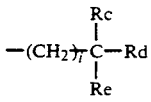

and i represents 0 or 1; $Z_1$ represents an oxygen atom, a sulfur atom or NRf; Rb is a substituted or an unsubstituted alkyl, aryl or heterocyclic group; Rc and Rd each represents halogen atoms or groups selected from the groups consisting of Rb and $Z_2$Rg; Re is a hydrogen atom or a group as defined for Rc and Rd; Rf is a hydrogen atom or a group as defined for Rb; $Z_2$ represents an oxygen atom or a sulfur atom or NRh; Rg is a group as defined for Rf; Rh is a group as defined for Rf; Rc may bond with Rd and/or Re to form one or two carbon rings or hetero rings and these may also possess substituents. $R_1$, X and B signify the same groups, atomic groups and atoms as noted earlier; $R_3$ is an anilino, acylamino, ureido, carbamoyl, alkoxy, allyloxycarbonyl, alkoxycarbonyl or N-heterocyclic group and preferably these groups are groups containing oil-solubilizing groups. $R_4$ is a substituted or an unsubstituted aryl group and is preferably a substituted phenyl group, more preferably a 2,4,6-trichlorophenyl group.

Preferred pyrazolone couplers of this general formula can be represented by the following general formula in which $R_1$, $R_3$, $R_4$, Rc, Rd, Re, X and B signify the same atoms, atomic groups or groups as noted above and i is 0 or 1;

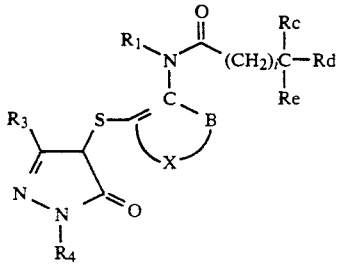

A second preferred pyrazolone coupler is represented by the following general formula:

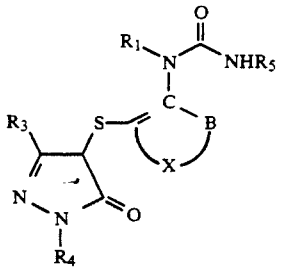

wherein $R_5$ represents a substituted or an unsubstituted alkyl, aryl or heterocyclic group; $R_1$, $R_3$, $R_4$, X and B signify the same groups, atomic groups, and atoms as noted above. Preferably, $R_3$ is a group represented by —NH—$Y_2$ and $R_4$ is a 2,4,6-trichlorophenyl group. $Y_2$ is a substituted or an unsubstituted aryl, arylcarbonyl or arylaminocarbonyl group.

A third preferred pyrazolone coupler is represented by the following general formula:

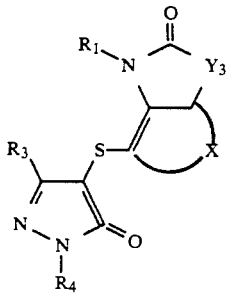

wherein $R_1$, $R_3$, $R_4$ and X signify the same atoms, groups and atomic groups as noted above. $Y_3$ represents a substituted or an unsubstituted methylene or ethylene group or

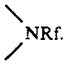

(Examples of substituents for the substituented methylene and ethylene groups include those which are recited in the definition of $L_1$ and $L_2$.) Rf signifies the same atoms and groups as noted above. A still more preferred pyrazolone coupler of this general formula is represented by the following general formula:

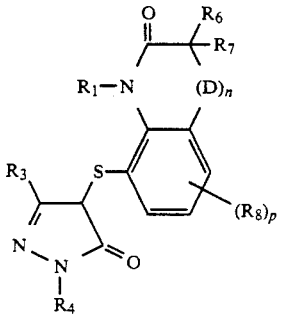

wherein $R_1$, $R_3$ and $R_4$ each signifies the same atoms and groups as noted above. $R_6$ and $R_7$ each represents alkyl or aryl groups and $R_8$ represents the substituents as defined for $L_1$ and $L_2$. D represents a methylene group or an oxygen, nitrogen or sulfur atom and n represents an integer from 0 to 2 when it is a methylene group and is 1 in the other cases. p is an integer from 0 to 3.

The phrase "coupler moiety" discussed hereinbelow is the portion excluding the coupling elimination group. The term "coupler" refers to the entire body including both the coupler moiety and the coupling elimination group.

The coupling moiety reacts with an oxidized color development agent to form a dye and more specifically a magenta dye which is a pyrazolone coupler that is well-known and in common use in the photographic industry. Representative examples of suitable pyrazolone coupler moieties that may be cited include the substances disclosed in U.S. Pat. Nos. 4,413,054, 4,443,536, 4,522,915, 4,336,325, 4,199,361, 4,351,897, and 4,385,111, JP-A-60-170854, JP-A-60-194452 and JP-A-60-194451, U.S. Pat. Nos. 4,407,936, 3,419,391 and 3,311,476, UK Patent 1,357,372 and U.S. Pat. Nos. 2,908,573, 2,908,573, 3,062,653, 3,519,429, 3,152,896, 2,311,082, 2,343,703 and 2,369,489 and in the inventions cited in these patents. When the coupling elimination groups are substituted on the pyrazolone coupler moieties of these patents, it is possible to effect replacement with the coupling elimination groups represented by general formula (I) of the present invention. The pyrazolone couplers of the invention can also be used together with other pyrazolone couplers disclosed in the patents noted above.

Examples of preferred coupler moieties are represented in the following general formula:

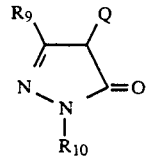

wherein Q represents a coupling elimination group of the invention; $R_9$ is an anilino, acylamino, ureido, carbamoyl, alkoxy, aryloxycarbonyl, alkoxycarbonyl or N-heterocyclic group; $R_{10}$ is a substituted or an unsubstituted aryl group and is preferably a phenyl group with at least one substituent selected from among halogen atoms and alkyl, alkoxy, alkoxycarbonyl, acylamino, sulfamido, sulfonamido and cyano groups. The carbon atoms and the nitrogen atoms of these substituents may be unsubstituted or substituted by groups which do not reduce the coupler's effects. $R_9$ is preferably an anilino group and is more preferably an anilino group represented by the following general formula:

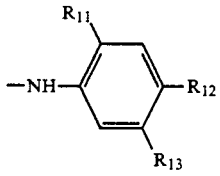

wherein $R_{11}$ is a 1-30C alkoxy group, aryloxy group or halogen atom (preferably a chlorine atom); $R_{12}$ and $R_{13}$ are respectively hydrogen atoms, halogen atoms (e.g., chlorine, bromine, fluorine), alkyl groups (e.g., 1-30C alkyl groups), alkoxy groups (e.g., 1-30C alkoxy groups) or acylamino, sulfonamido, sulfamoyl, sulfamido, carbamoyl, diacylamino, aryloxycarbonyl, alkoxycarbonyl, alkoxysulfonyl, aryloxysulfonyl, alkanesulfonyl, arylsulfonyl, alkylthio, arylthio, alkoxycarbonylamino, alkylureido, acyl, nitro or carboxyl groups. For example, $R_{12}$ and $R_{13}$ may each be a hydrogen atom or a ballast group.

$R_{10}$ is preferably a substituted phenyl group. The substituents thereof include halogen atoms (e.g., chlorine, bromine, fluorine), 1-22C alkyl groups (e.g., methyl, ethyl, propyl, t-butyl, tetradecyl), 1-22C alkoxy groups (e.g., methoxy, ethoxy, dodecyloxy), 1-23C alkoxycarbonyl groups (e.g., methoxycarbonyl, ethoxycarbonyl, tetradecyloxycarbonyl), acylamino groups (e.g., α-(3-pentadecylphenoxy)-butylamide) and/or amino groups. More preferably, $R_{10}$ is a 2,4,6-trichlorophenyl group.

More specifically, $R_{12}$ and $R_{13}$ include hydrogen atoms, halogen atoms (e.g., chlorine, bromine, fluorine), 1-30C straight chain or branched chain alkyl groups (e.g., methyl, trifluoromethyl, ethyl, t-butyl, tetradecyl), 1-30C alkoxy groups (e.g., methoxy, ethoxy, 2-ethylhexyloxy, tetradecyloxy), acylamino groups (e.g., acetamido, pentylphenoxy)acetamide, α-(2,4-di t-pentylphenoxy)butylamido, α-(4-hydroxy-3-t-butylphenoxy)tetradecaneamido, 2-oxopyrrolidin-1-yl, 2-oxy-5-tetradecylpyrrolin-1-yl, N-methyltetradecaneamido, t-butylcarbonamido), sulfonamido groups (e.g., methanesulfonamido, benzenesulfonamido, p-toluenesulfonamido, p-dodecylbenzenesulfonamido, N-methyltetradecylsulfonamido, hexadecanesulfonamido), sulfamoyl groups (e.g., N-methylsulfamoyl, N-hexadecylsulfamoyl, N,N-dimethylsulfamoyl, N-(3-(dodecyloxy)propyl)sulfamoyl, N-(4-(2,4-di-t-pentylphenoxy)butyl)sulfamoyl, N-methyl-N-tetradecylsulfamoyl, N-dodecylsulfamoyl), sulfamido groups (e.g., N-methylsulfamido, N-octadecylsulfamido), carbamoyl groups (e.g., N-methylcarbamoyl, N-octadecylcarbamoyl, N-(4-(2,4-di-t-pentylphenoxy)butyl)carbamoyl, N-methyl-N-tetradecylcarbamoyl, N,N-dioctylcarbamoyl), diacylamino groups (e.g., N-succinimido, N-phthalimido, 2,5-dioxo-1-oxazolidinyl, 3-dodecyl-2,5-dioxo-1-imidazolyl, N-acetyl-N-dodecylamino), aryloxycarbonyl groups (e.g., phenoxycarbonyl, p-dodecyloxyphenoxycarbonyl), 2-30C alkoxycarbonyl groups (e.g., methoxycarbonyl, tetradecyloxycarbonyl, ethoxycarbonyl, benzyloxycarbonyl, dodecyloxycarbonyl), 1-30C alkoxysulfonyl groups (e.g., methoxysulfonyl, octyloxysulfonyl, tetradecyloxysulfonyl, 2-ethylhexyloxysulfonyl), aryloxysulfonyl groups (e.g., phenoxysulfonyl, 2,4-di-t-pentylphenoxysulfonyl), 1-30C alkanesulfonyl groups (e.g., methanesulfonyl, octanesulfonyl, 2-ethylhexanesulfonyl, hexadecanesulfonyl), arylsulfonyl groups (e.g., benzenesulfonyl, 4-nonylbenzenesulfonyl, p-toluenesulfonyl), 1-22C alkylthio groups (e.g., ethylthio, octylthio, benzylthio, tetradecylthio, 2-(2,4-di-t-pentylphenoxy)ethylthio), arylthio groups (e.g., phenylthio, p-tolylthio), alkoxycarbonylamino groups (e.g., ethoxycarbonylamino, benzyloxycarbonylamino, hexadecyloxycarbonylamino), alkylureido groups (e.g., N-methylureido, N,N-dimethylureido, N-methyl-N-dodecylureido, N-hexadecylureido, N,N-dioctadecylureido, N,N-dioctyl-N'-ethylureido), acyl groups (e.g., acetyl, benzoyl, octadecanoyl, p-dodecaneamidobenzoyl, cyclohexanecarbonyl), nitro groups, cyano groups and carboxyl groups.

The alkoxy and aryloxy groups of $R_{11}$ further include the case where the alkoxy groups are methoxy, ethoxy, propoxy, butoxy, 2-methoxyethoxy, sec-butoxy, hexyloxy, 2-ethylhexyloxy, 2-(2,4-di-t-pentylphenoxy)ethoxy and 2-dodecyloxyethoxy groups and the aryloxy groups are phenoxy, α and β-naphthyloxy and 4-tolyloxy groups.

A monomer containing a pyrazolone coupler with the elimination group represented by general formula (I) may serve to form a copolymer with a non-color-forming ethylenic monomer which does not couple with the oxidation products of primary aromatic amine developing agents.

Representative examples of non-color-forming ethylenic monomers which do not couple with the oxidation products of primary aromatic amine developing agents include acrylic acid, α-chloroacrylic acid, α-alkylacrylic acid (e.g., methacrylic acid) and esters or amides derived from these acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxy methacrylate), methylene bisacrylamide, vinyl esters (e.g., vinyl acetate, vinyl propionate and vinyl laurate), acrylonitrile, methacrylonitrile, aromatic vinyl compounds (e.g., styrene and derivatives thereof, vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid, maleic anhydride, maleic acid esters, N-vinyl-2-pyrrolidone, N-vinylpyridine and 2 or 4-vinylpyridine, etc. Two or more non-coloring unsaturated ethylenic monomers may be used together. For example, one can have n-butyl acrylate and methylcrylate, styrene and methacrylic acid, methacrylic acid and acrylamide or methyl acrylate and diacetone acrylamide, etc.

As is well-known in the field of polymer color couplers, it is possible to select noncoloring unsaturated ethylenic monomers for copolymerization with solid, water-soluble monomers in such a manner as to have good effects on the physical and/or chemical properties of the copolymer that is formed, e.g., solubility, compatibility with photographic colloid composition binders, for example, gelatin and the pliability and thermal stability, etc. of the copolymer.

Polymer couplers used in the invention may be water soluble or water-insoluble, but within the various substances polymer coupler latexes are particularly preferred.

Below, specific examples of coupling elimination groups Q that are represented by general formula (I) are given, although there is no limitation to these examples.

Q-1)

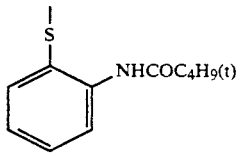

-continued

Q-2)

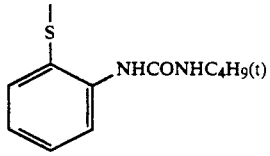

Q-3)

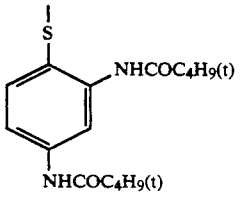

Q-4)

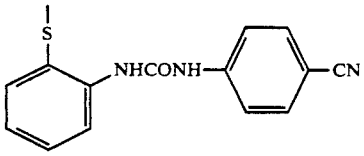

Q-5)

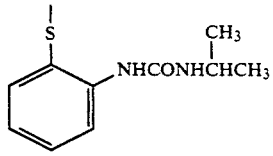

Q-6)

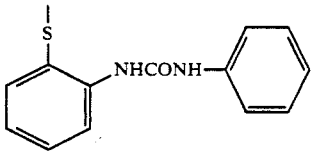

Q-7)

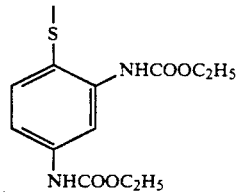

Q-8)

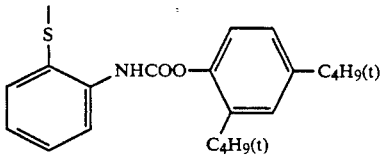

Q-9)

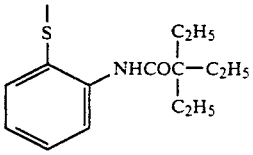

-continued
Q-10)
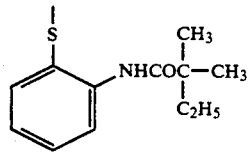
Q-11)
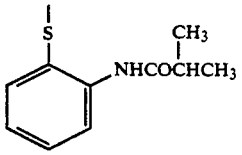
Q-12)
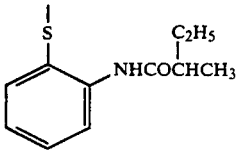
Q-13)
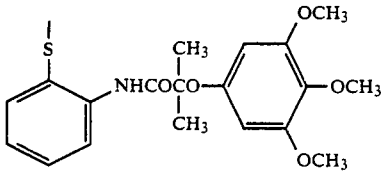
Q-14)
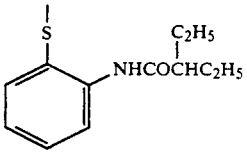
Q-15)
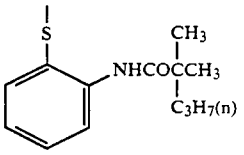
Q-16)
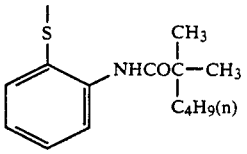
Q-17)
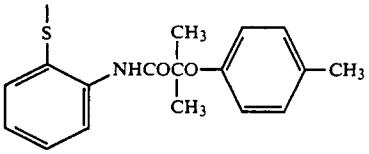
Q-18)
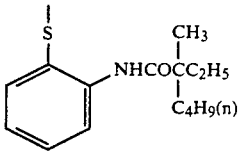
-continued
Q-19)
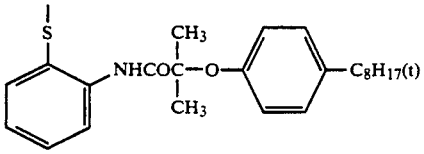
Q-20)
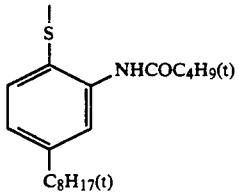
Q-21)
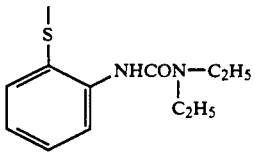
Q-22)
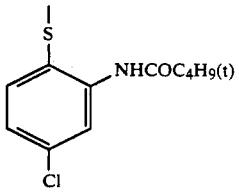
Q-23)
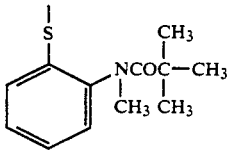
Q-24)
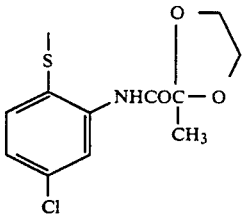
Q-25)
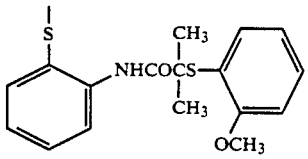
Q-26)
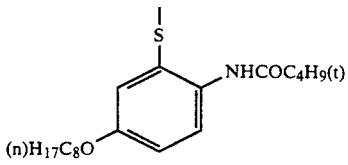

-continued
Q-27)
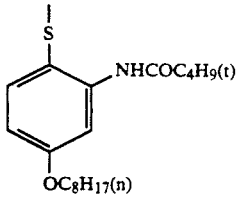
Q-28)
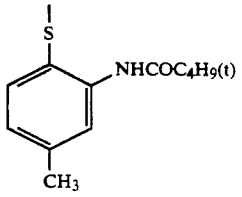
Q-29)
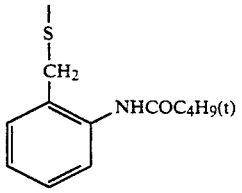
Q-30)
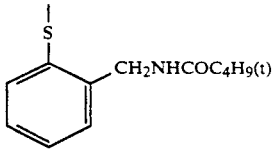
Q-31)
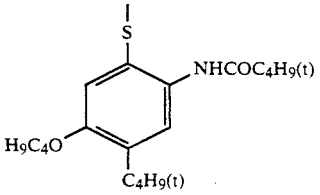
Q-32)
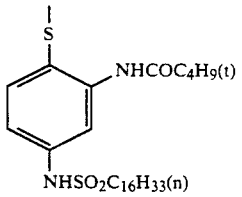
Q-33)
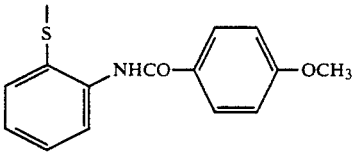
Q-34)
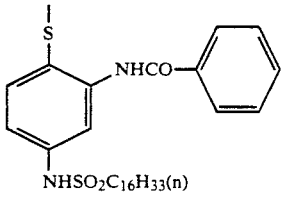
-continued
Q-35)
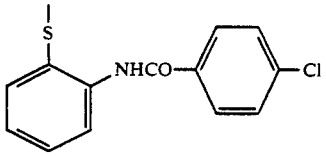
Q-36)
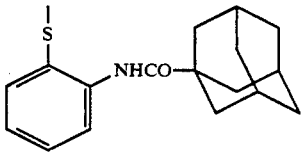
Q-37)
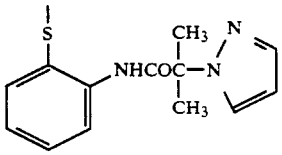
Q-38)
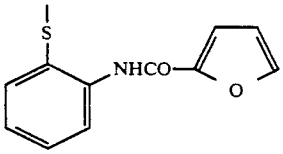
Q-39)
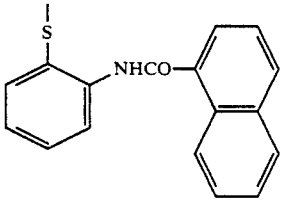
Q-40)
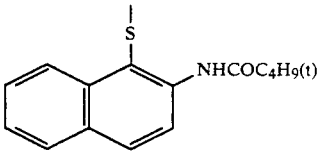
Q-41)
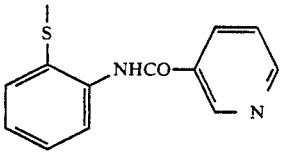
Q-42)
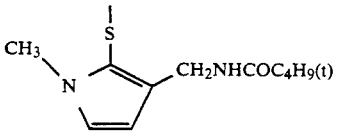
Q-43)
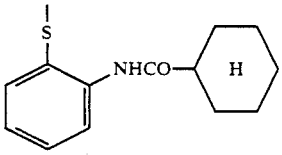

-continued
Q-44)
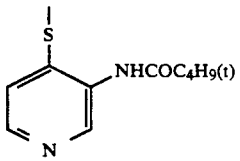
Q-45)
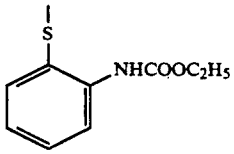
Q-46)
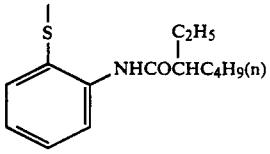
Q-47)
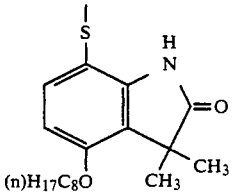
Q-48)
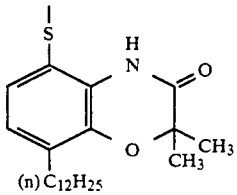
Q-49)
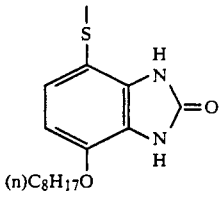
Q-50)
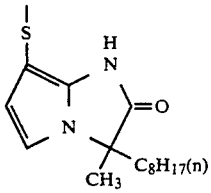
Q-51)
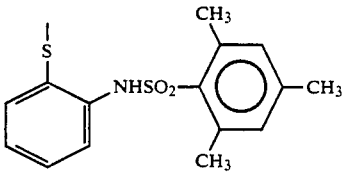
-continued
Q-52)
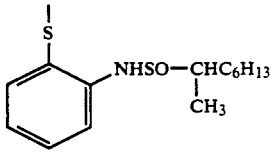
Q-53)
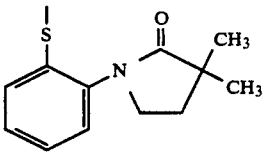
Q-54)
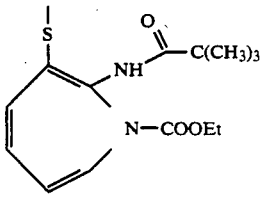
Q-55)
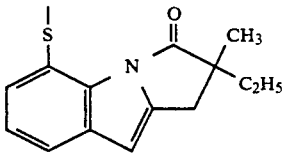
Q-56)
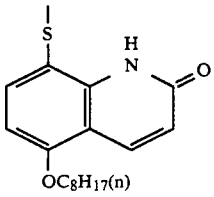
Q-57)
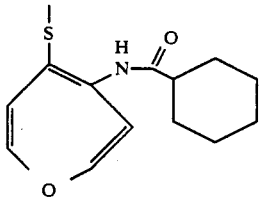
Q-58)
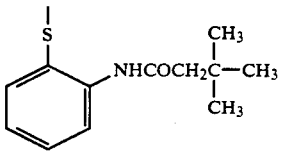
Q-59)
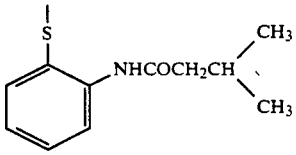

-continued
Q-60)
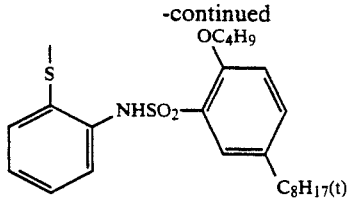
Specific examples of the couplers of the present invention will now be given, although the invention is not limited to these representative examples.
(M-1)
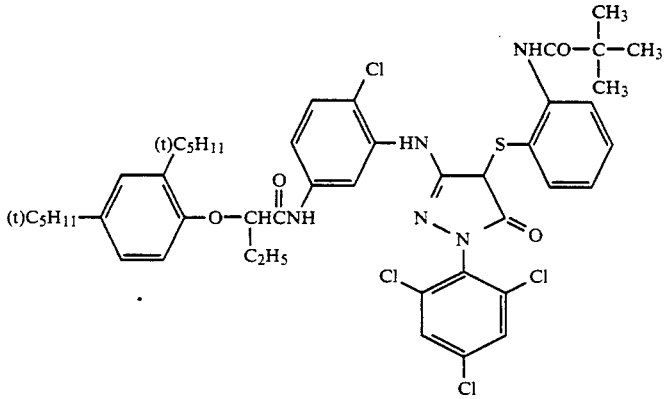
(M-2)
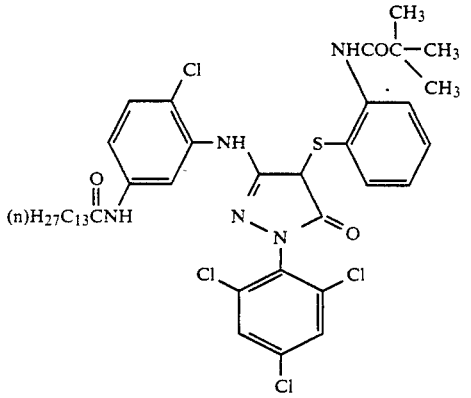
(M-3)
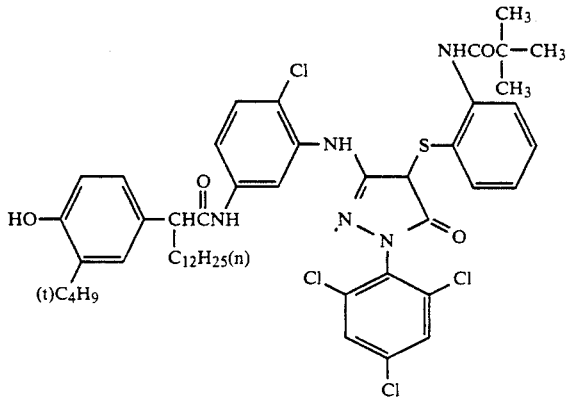

-continued
(M-4)
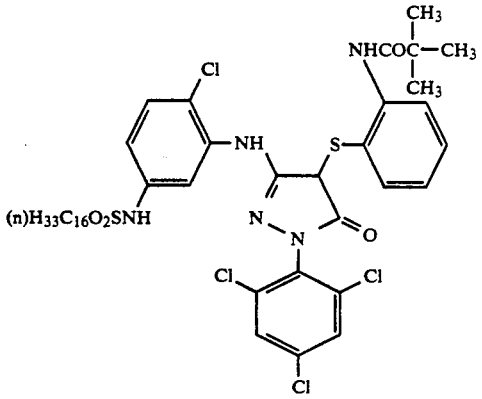
(M-5)
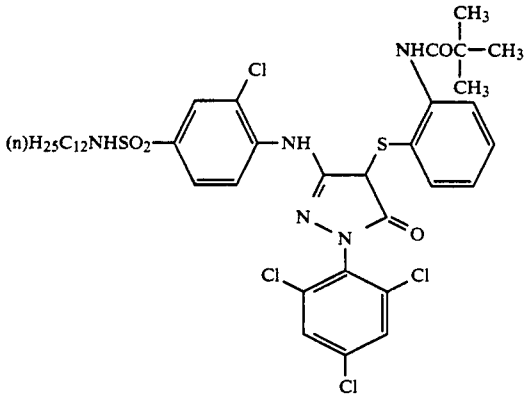
(M-6)
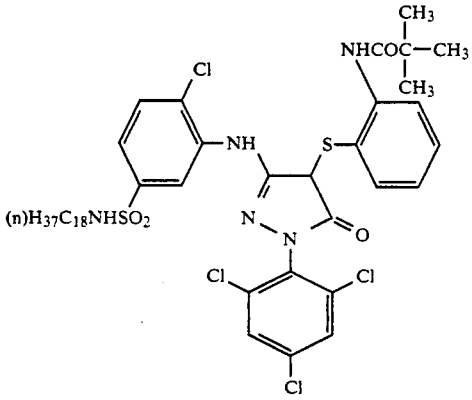
(M-7)
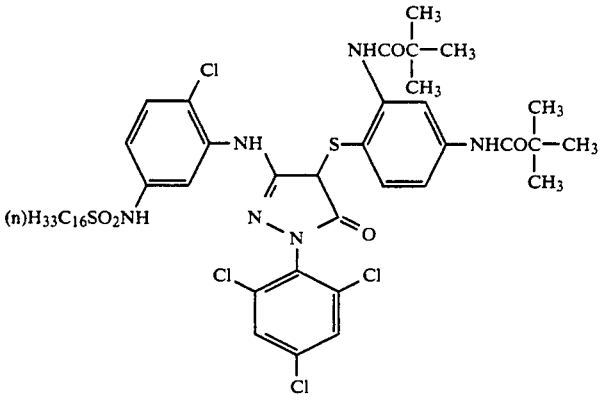

-continued
(M-8)
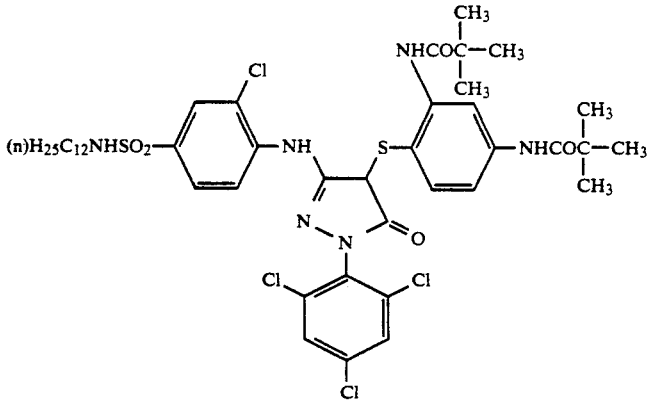
(M-9)
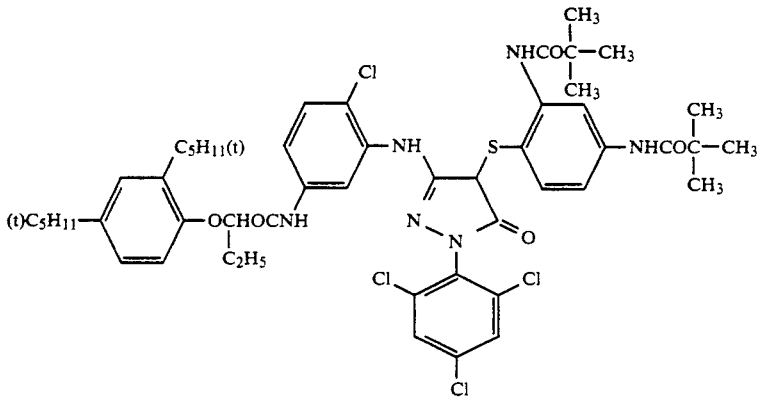
(M-10)
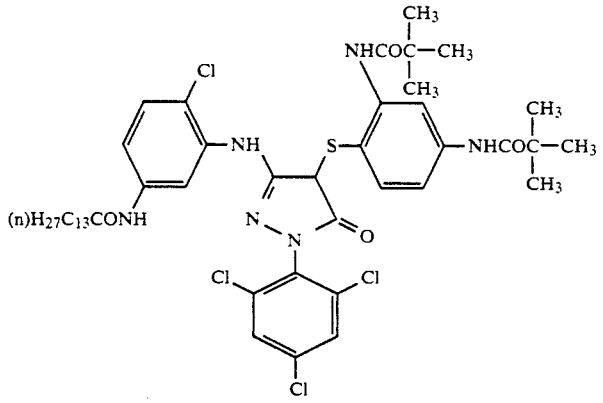
(M-11)
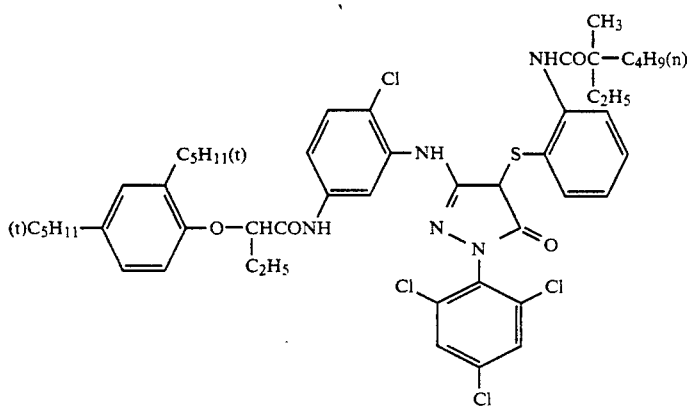

-continued
(M-12)
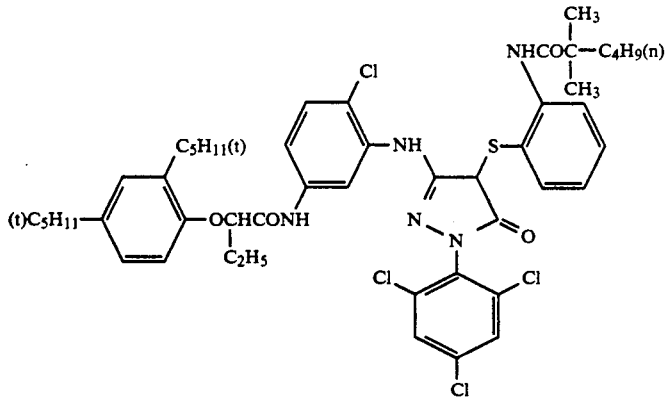
(M-13)
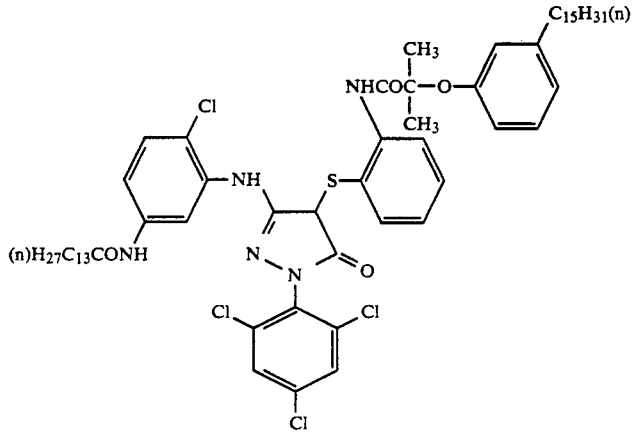
(M-14)
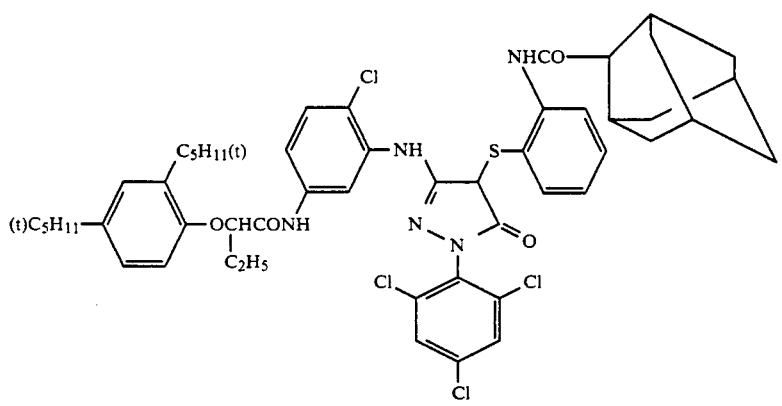
(M-15)
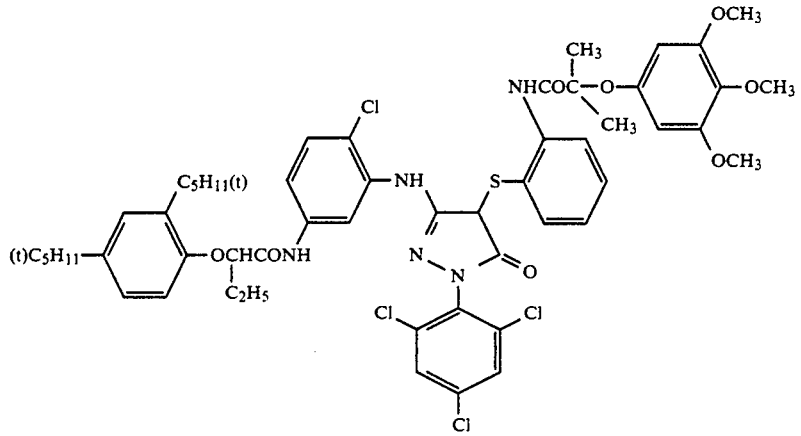

-continued
(M-16)
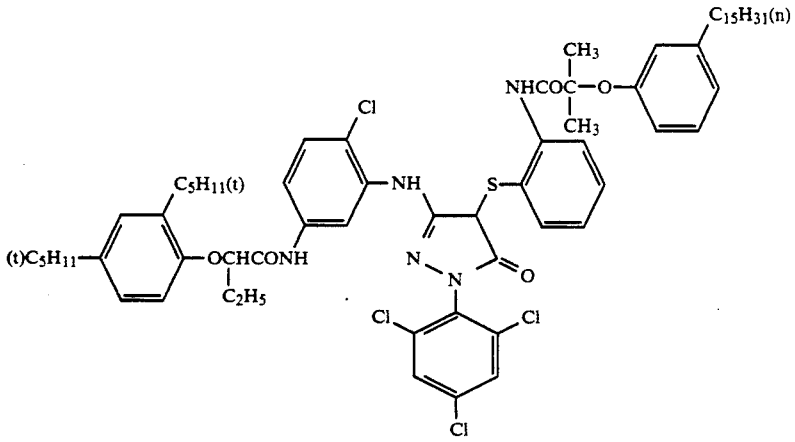
(M-17)
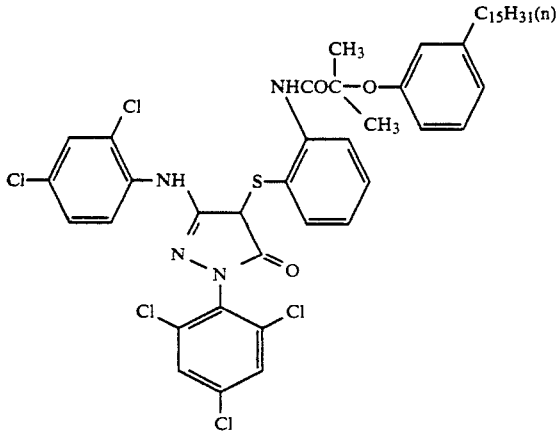
(M-18)
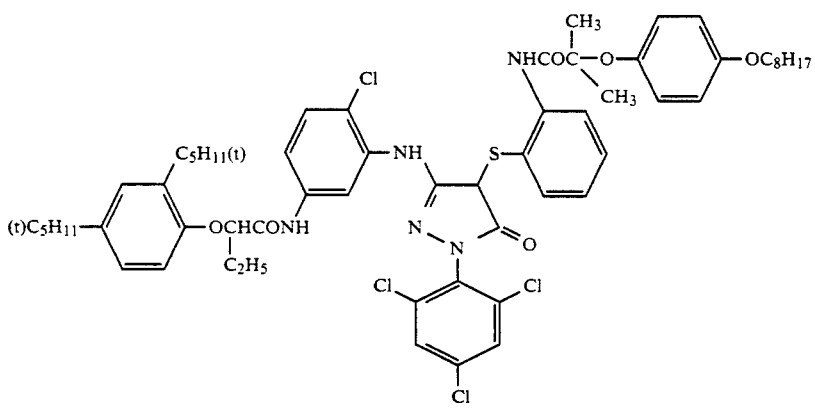
(M-19)
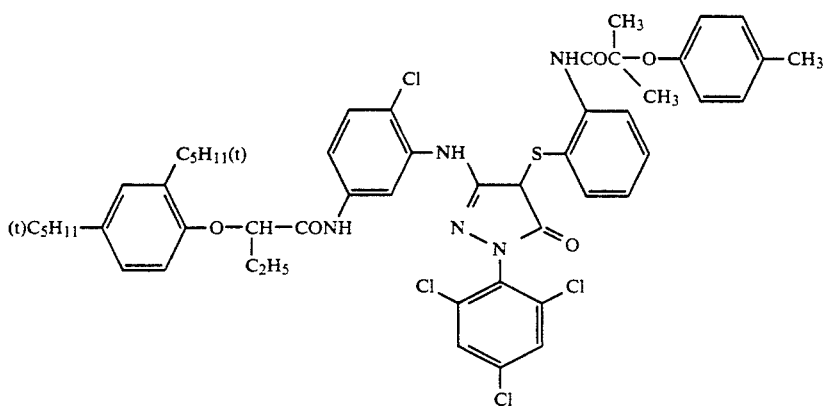

-continued
(M-20)
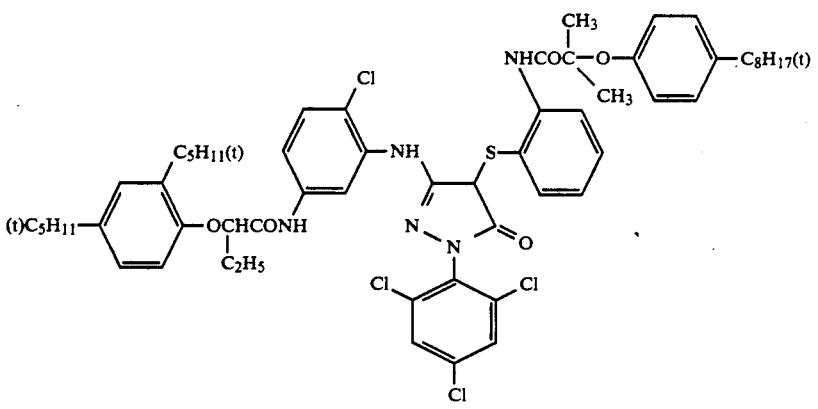
(M-21)
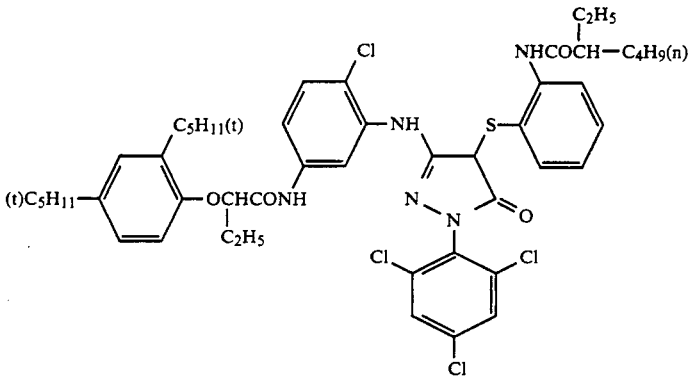
(M-22)
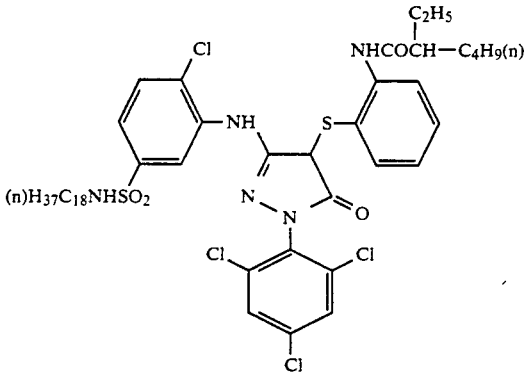
(M-23)
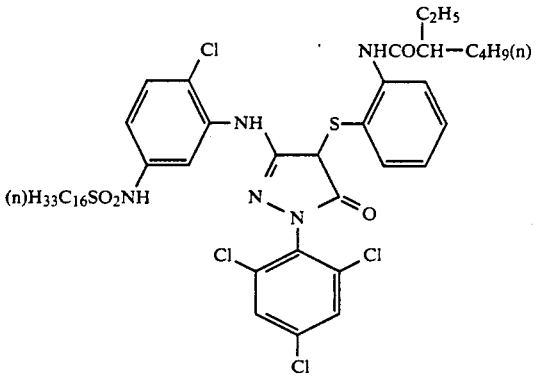

-continued
(M-24)
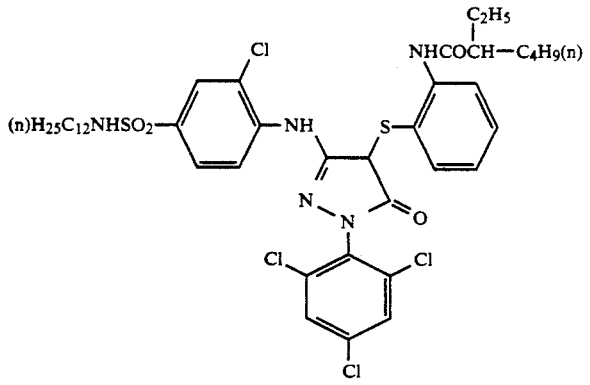
(M-25)
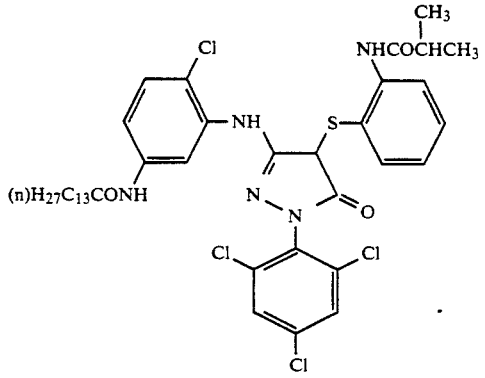
(M-26)
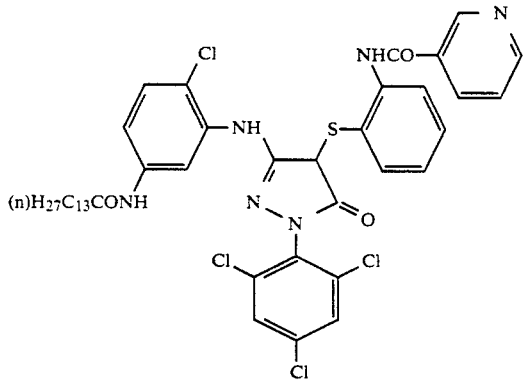
(M-27)
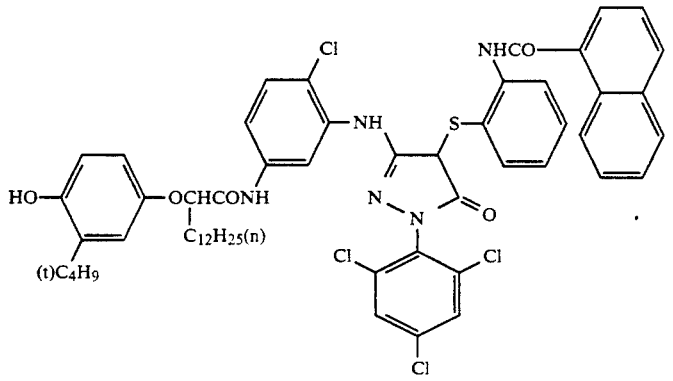

-continued
(M-28)
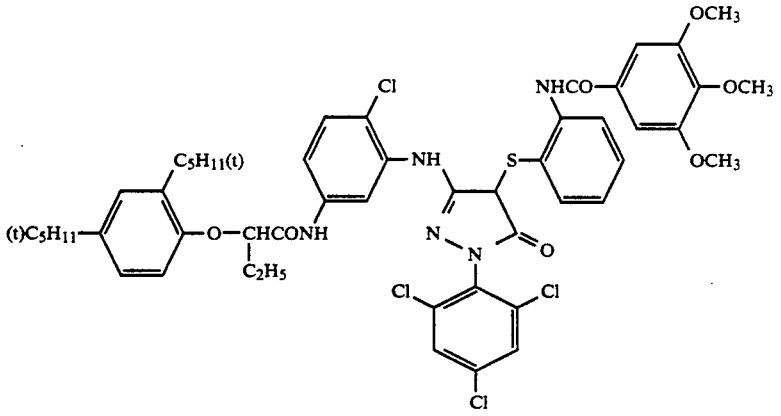
(M-29)
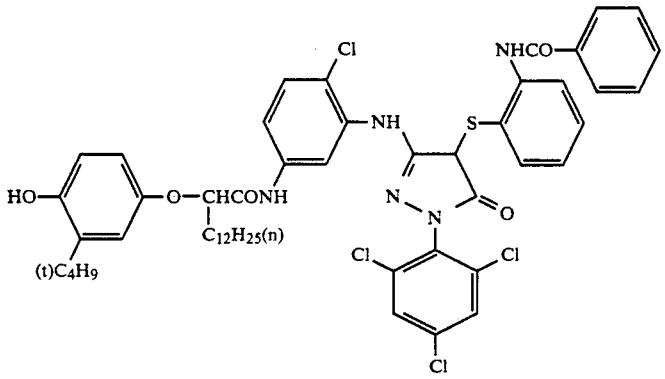
(M-30)
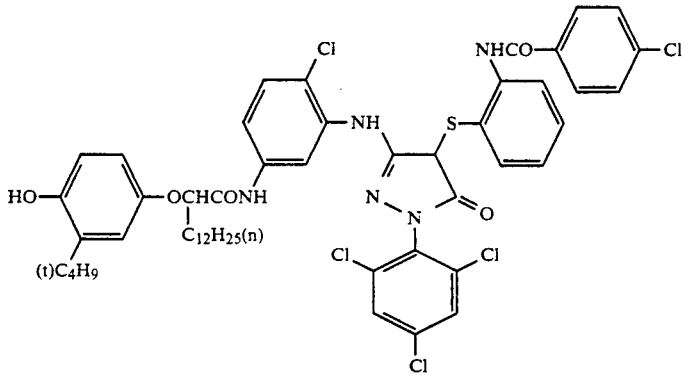
(M-31)
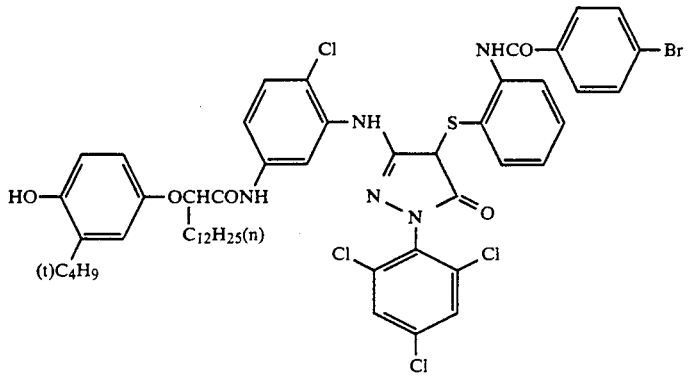

-continued
(M-32)
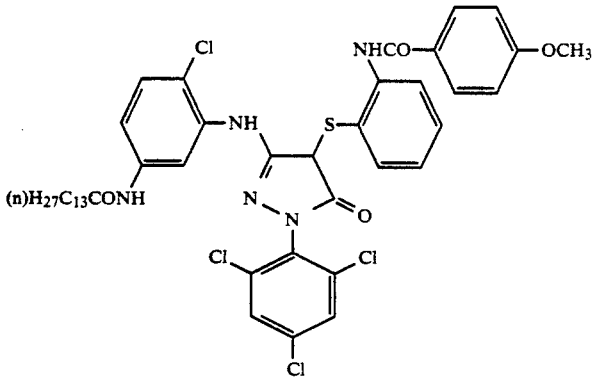
(M-33)
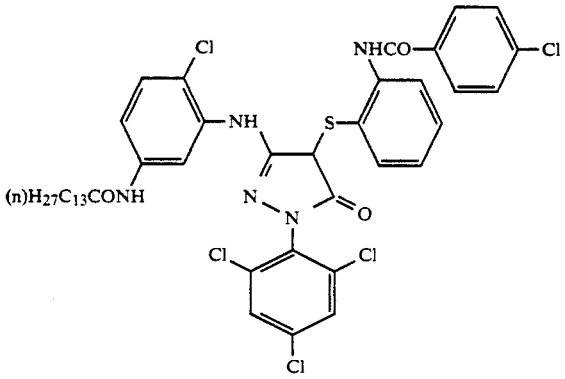
(M-34)
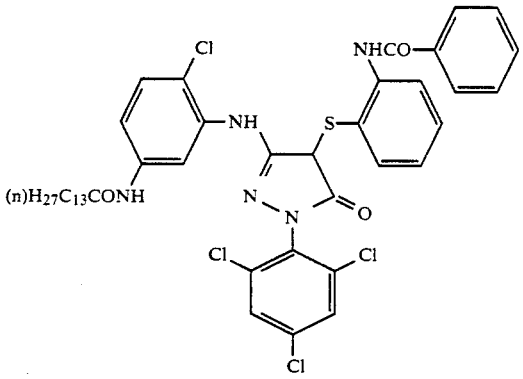
(M-35)
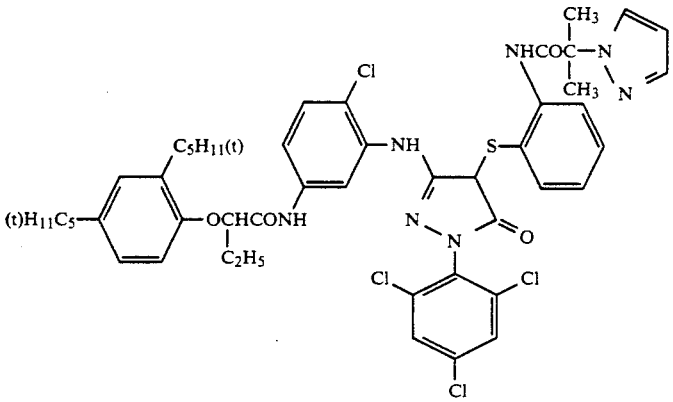

-continued
(M-36)
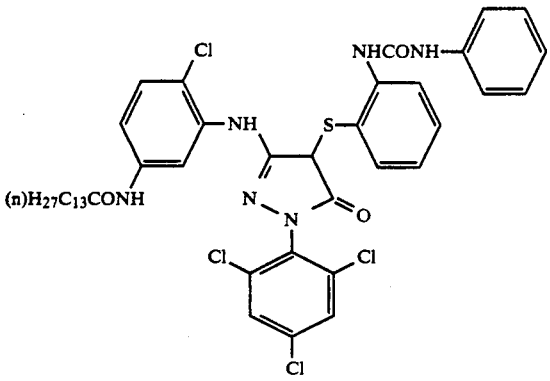
(M-37)
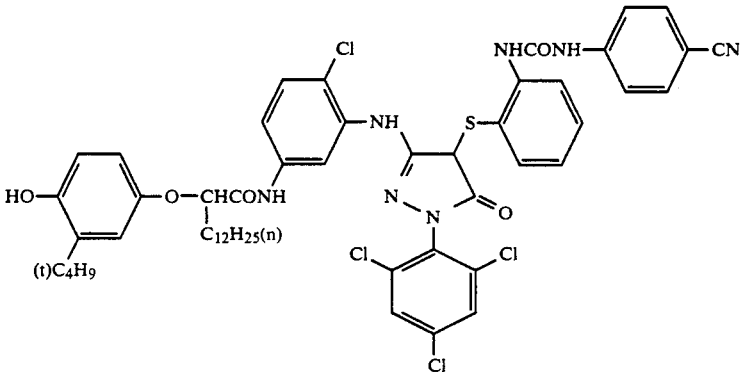
(M-38)
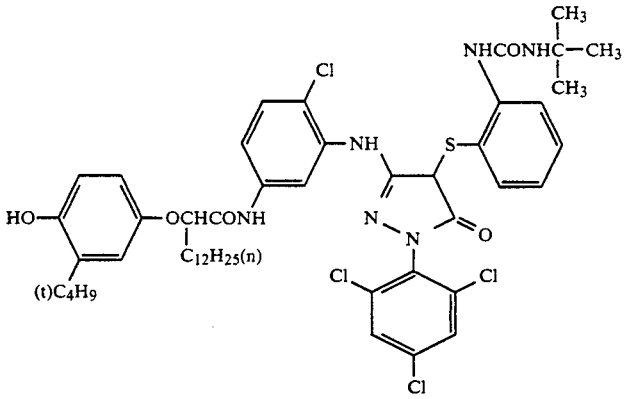
(M-39)
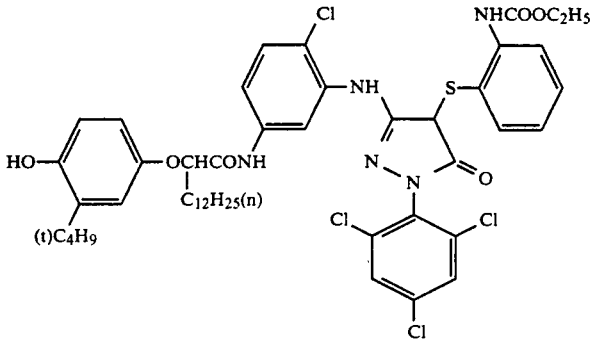

-continued
(M-40)
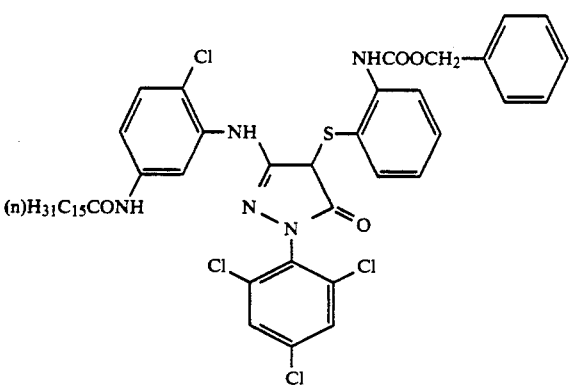
(M-41)
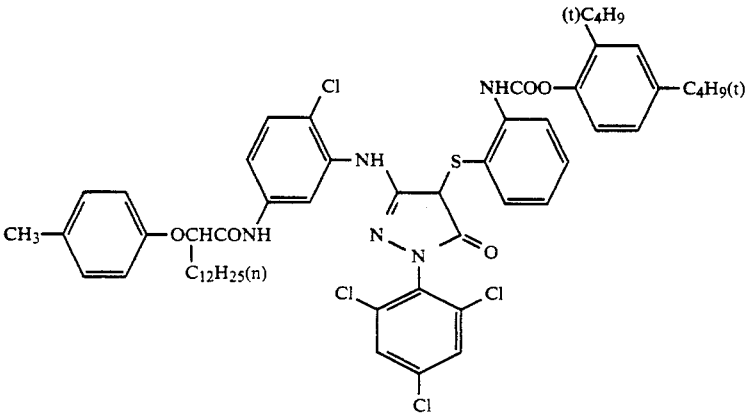
(M-42)
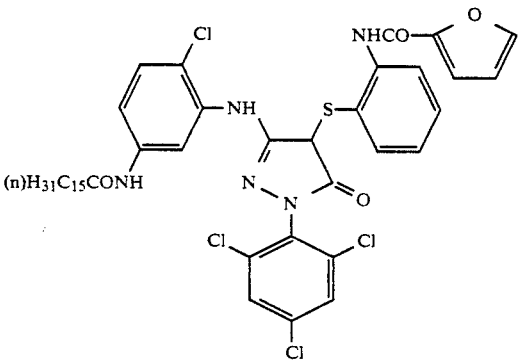
(M-43)
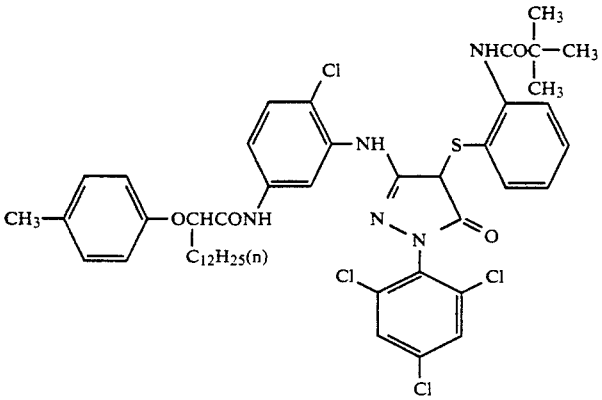

-continued
(M-44)
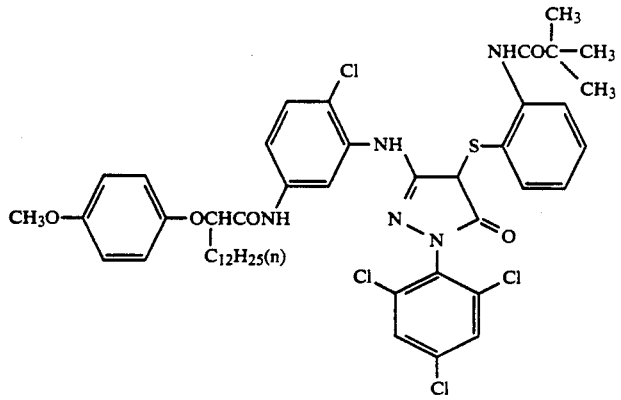
(M-45)
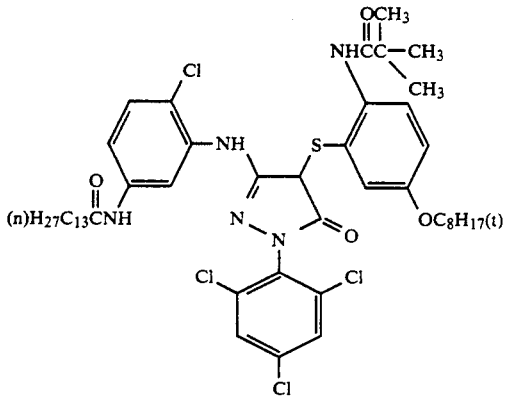
(M-46)
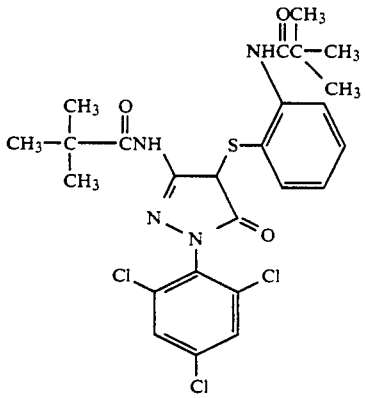
(M-47)
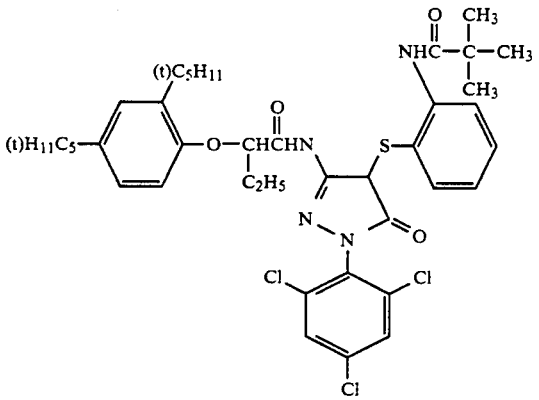

-continued
(M-48)
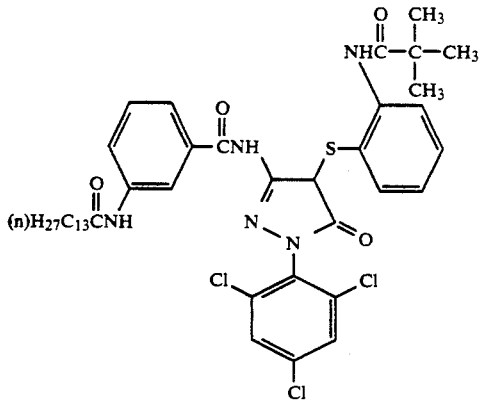
(M-49)
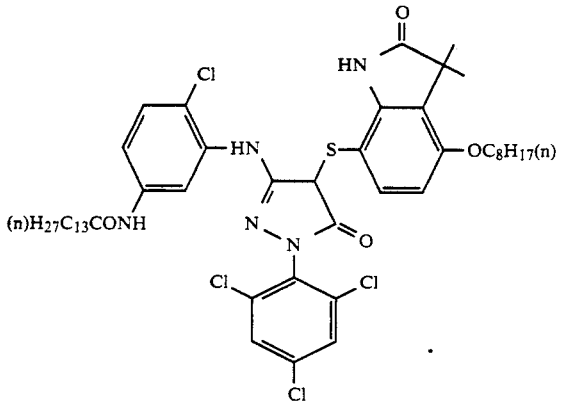
(M-50)
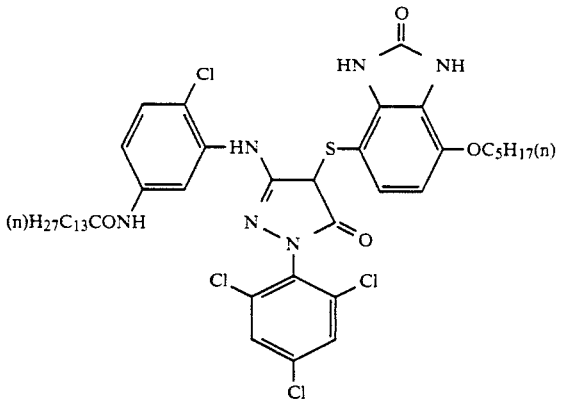
(M-51)
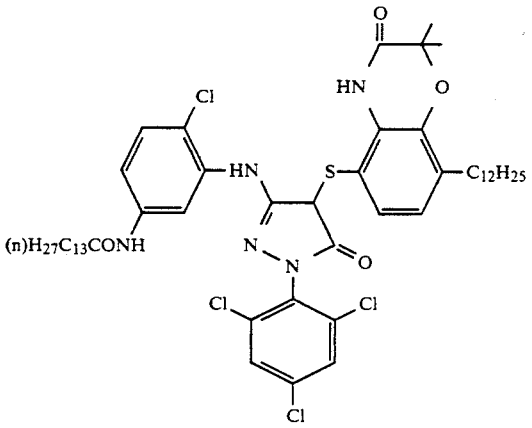

-continued
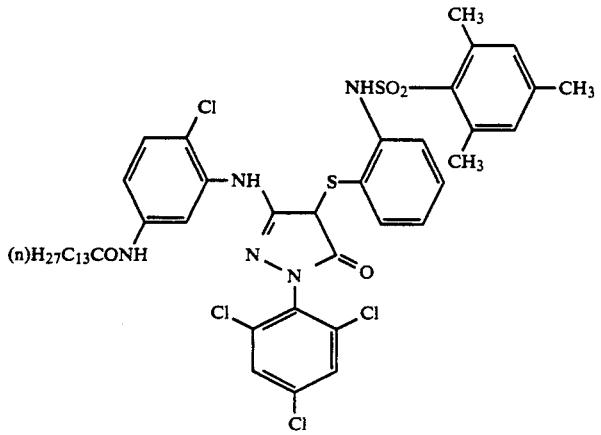
(M-52)
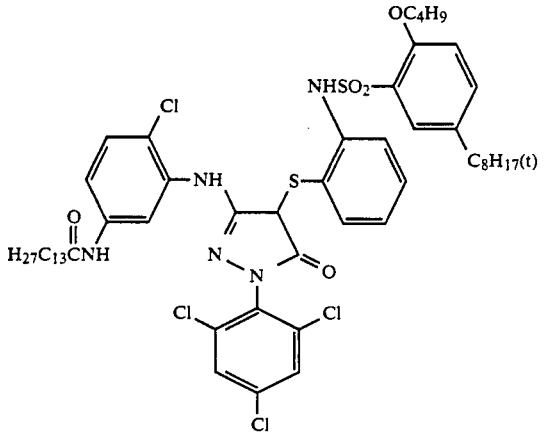
(M-53)
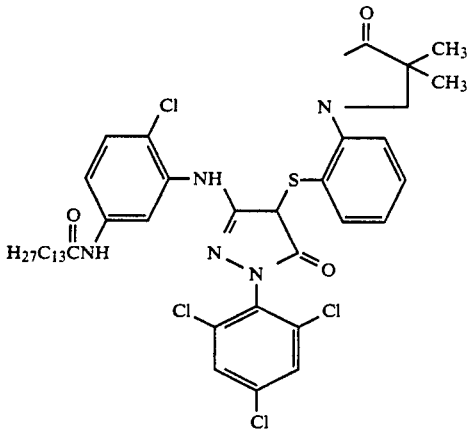
(M-54)

-continued
(M-55)
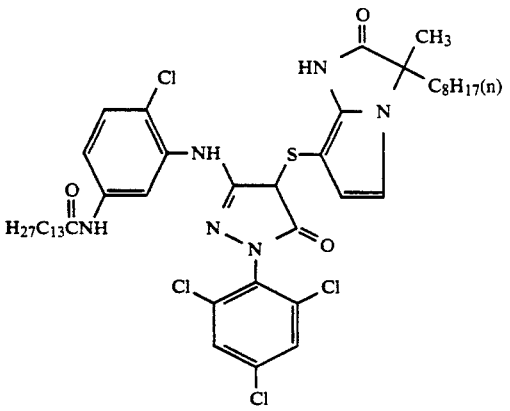
(M-56)
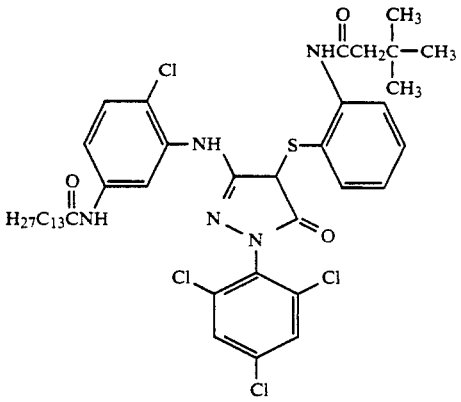
(M-57)
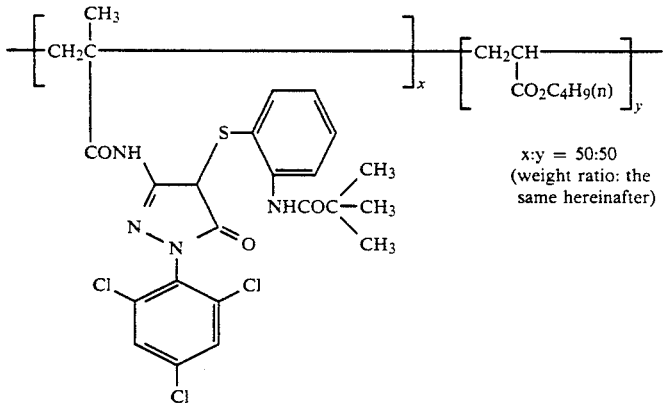
x:y = 50:50
(weight ratio: the same hereinafter)
(M-58)
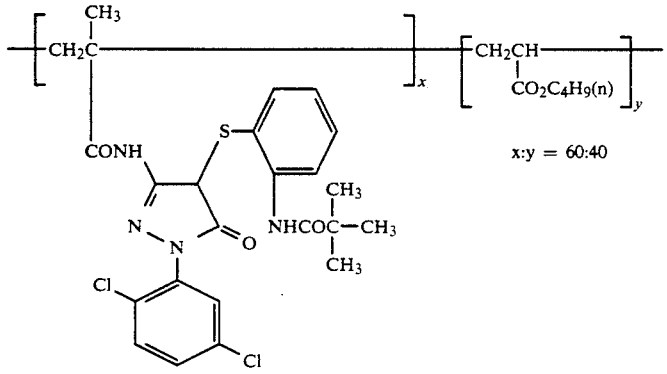
x:y = 60:40

-continued
(M-59)
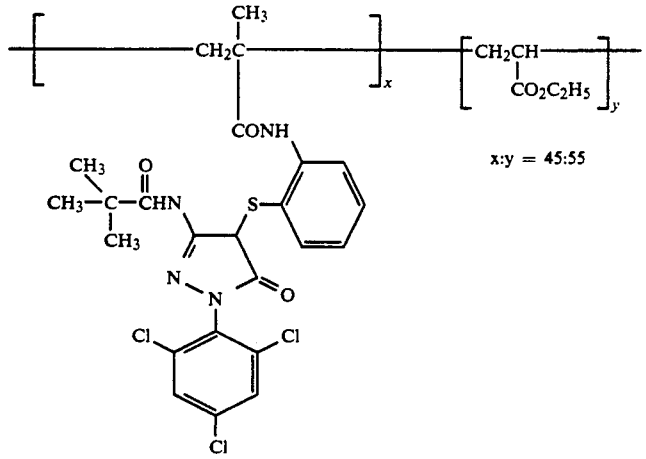
x:y = 45:55
(M-60)
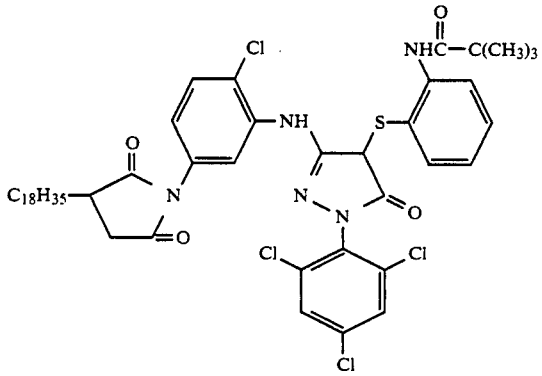
(M-61)
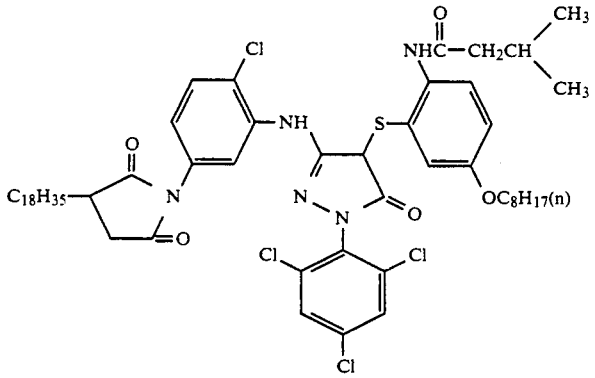
(M-62)
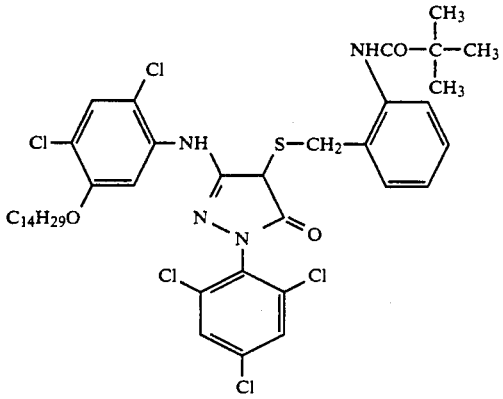

-continued
(M-63)
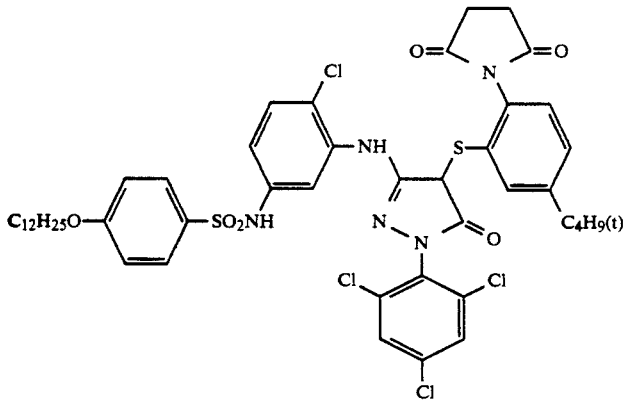
(M-64)
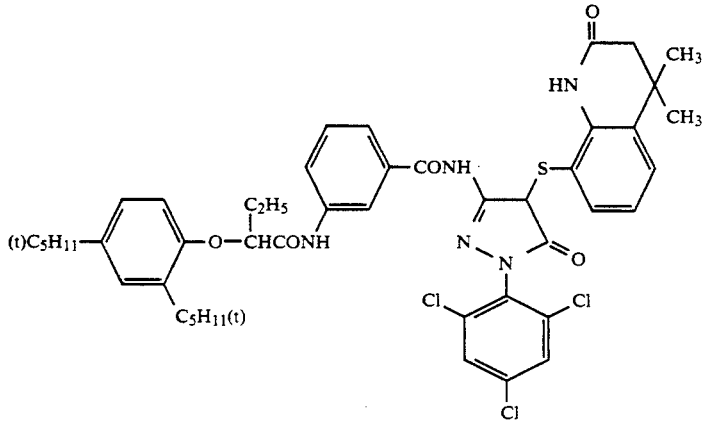
(M-65)
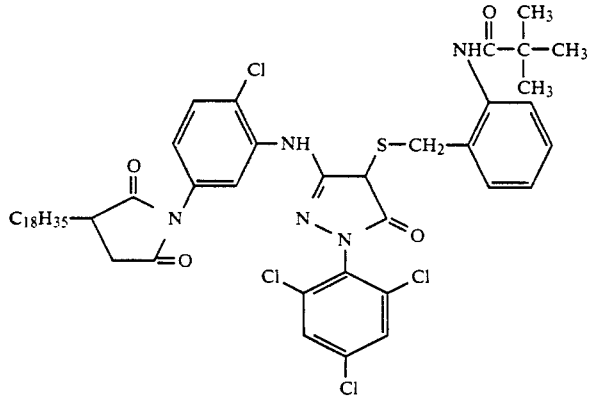
(M-66)
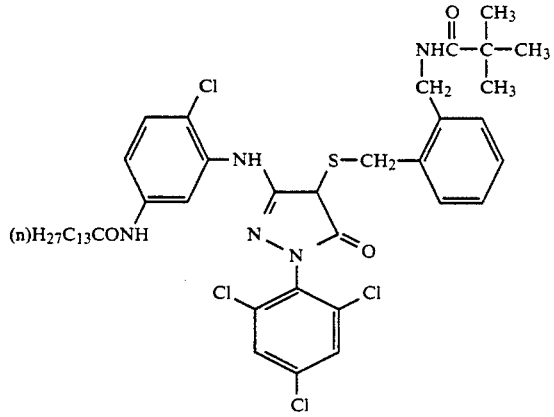
The magenta couplers of the present invention are used in an amount of $1\times10^{-3}$ mol to 1 mol, preferably The magenta couplers of the present invention may be arbitrarily added to the silver halide emulsion layers. However, it is preferred that the magenta couplers of the present invention are added to the green-sensitive silver halide emulsion layer. The amount of silver used in this green-sensitive silver halide emulsion layer is preferably 0.1 to 0.3 g/m$^2$.

The magenta couplers of the present invention can be synthesized according to the method described in WO88/04795.

Normally, yellow couplers, magenta couplers and cyan couplers which couple with the oxides of aromatic amine developing agents to produce the respective colors yellow, magenta and cyan are used in a color photographic material.

Acylacetamide derivatives such as benzoylacetoanilide and pivaloylacetoaniline are preferred as yellow couplers for use in the invention.

Of these substances, substances represented by the following general formulas (Y-1) and (Y-2) are suitable as yellow couplers:

[Y-1]

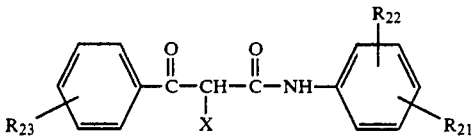

[Y-2]

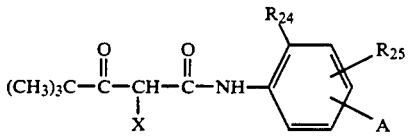

wherein X represents an hydrogen atom or a coupling elimination group; $R_{21}$ represents a 8-32C diffusion-resistant group; $R_{22}$ represents a hydrogen atom, 1 or more halogen atoms, or a lower alkyl (preferably having lower alkoxy (preferably having 1-4C) or 8-32C diffusion-resistant group; $R_{23}$ represents a hydrogen atom or a substitution group. When there are two or more $R_{23}$s, they may be the same or different. $R_{24}$ represents a halogen atom, an alkoxy group a trifluoromethyl group or an aryl group. $R_{25}$ represents a hydrogen atom, a halogen atom or an alkoxy group. A represents $-NHCOR_{26}$, $-NHSO_2R_{26}$, $-SO_2NHR_{26}$, $$-COOR_{26},\ SO_2\underset{\underset{R_{27}}{|}}{N}-R_{26},$$

wherein $R_{26}$ and $R_{27}$ each represents an alkyl group, an aryl group or an acyl group.

Details of pivaloylacetoanilide yellow couplers are disclosed in the Specifications of U.S. Pat. No. 4,622,287, column 3 line 15 to column 8 line 39, and U.S. Pat. No. 4,623,616, column 14 line 50 to column 19 line 41.

Details of benzoylacetoanilide yellow couplers are disclosed in U.S. Pat. Nos. 3,408,194, 3,933,501, 4,046,575, 4,133,958 and 4,401,752, etc.

The compounds (Y-1) to (Y-39) disclosed in column 37 to column 54 of the abovenoted U.S. Pat. No. 4,622,287 may be cited as specific examples of pivaloylacetoanilide yellow couplers, (Y-1), (Y-4), (Y-6), (Y-7), (Y-15), (Y-21), (Y-22), (Y-23), (Y-26), (Y-35), (Y-36), (Y-37), (Y-38) and (Y-39), etc. with these being preferred.

One may also cite the examples of compounds (Y-1) to (Y-33) on column 19 to column 24 of the abovenoted U.S. Pat. No. 4,623,616, (Y-2), (Y-7), (Y-8), (Y-12), (Y-20), (Y-21), (Y-23) and (Y-29), etc. with these being suitable.

Apart from these examples, one may also cite as suitable substances the typical specific example (34) disclosed in column 6 of the Specification of U.S. Pat. Nos. 3,408,194, the compounds (16) and (19) disclosed in column 8 of the Specification of U.S. Pat. No. 3,933,501, compound (9) disclosed in columns 7 to 8 of the Specification of U.S. Pat. No. 4,046,575, compound (1) disclosed in columns 5 and 6 of the Specification of U.S. Pat. No. 4,133,958, compound 1 disclosed in column 5 of the Specification of U.S. Pat. No. 4,401,752 and the compounds a) to h) indicated below:

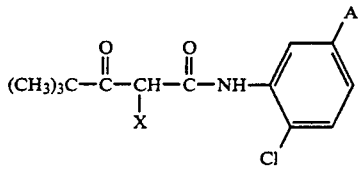

| Compound | A | X |
|---|---|---|
| a | $-COO\overset{CH_3}{\overset{\vert}{C}}HCOOC_{12}H_{25}$ | 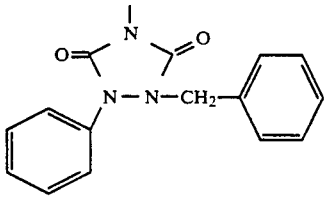 |

-continued

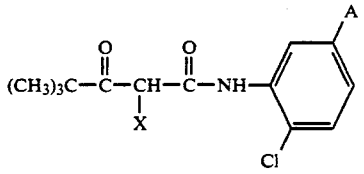

| Compound | A | X |
|---|---|---|
| b | $-COOCH(C_4H_9)COOC_{12}H_{25}$ | 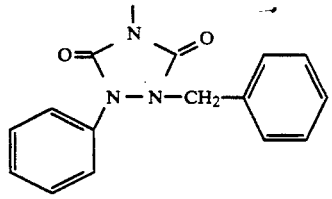 |
| c | 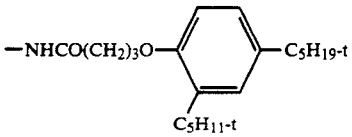 | 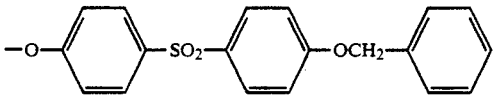 |
| d | 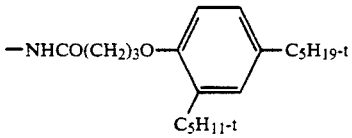 | 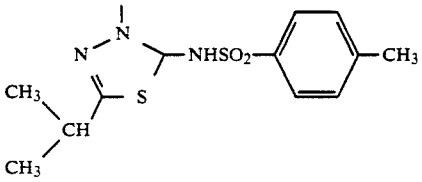 |
| e | 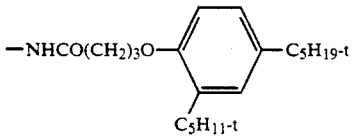 | 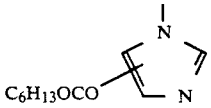 |
| f | $-NHSO_2C_{12}H_{25}$ | 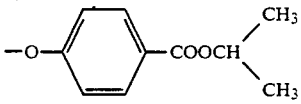 |
| g | $-NHSO_2C_{16}H_{33}$ | 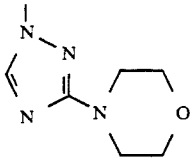 |
| h | $-NHCO(CH_3)CHCH_2SO_2C_{12}H_{25}$ | 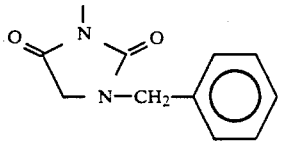 |

Among these couplers, the couplers in which the elimination atoms are nitrogen atoms are particularly preferred.

Other magenta couplers that are employable together with the pyrazolone magenta couplers that are used in the invention include, for example, oil-protected type couplers, indazolone couplers, cyanoacetyl couplers and preferably pyrazoloazole couplers, such as pyrazolotriazole or 5-pyrazolone couplers. Within the 5-pyrazolone type couplers, couplers in which the 3 position is substituted by an arylamino or an acylamino group are preferable from the point of view of the hue of the dye and the density of the color produced. Typical examples of such couplers are disclosed in U.S. Pat. Nos. 2,311,082, 2,343,703, 2,600,788, 2,908,573, 3,062,653, 3,152,896 and 3,936,015, etc. The nitrogen atom elimination groups disclosed in U.S. Pat. No. 4,310,619 and the arylthio elimination groups disclosed in U.S. Pat. No. 4,351,897 are preferred as elimination groups for the 2-equivalent 5-pyrazolone couplers. Good color density is also achievable with the 5-pyrazolone couplers possessing the ballast groups disclosed in European Patent 73,636.

The pyrazolobenzimidazoles disclosed in U.S. Pat. No. 2,369,879 and, preferably, the pyrazolo(5,1-c)-(1,2,4)triazoles disclosed in U.S. Pat. No. 3,725,067, the pyrazolotetrazoles disclosed in *Research Disclosure* 24220 (June 1984) and the pyrazolopyrazoles disclosed in *Research Disclosure* 24230 (June 1984) may be cited as pyrazoloazole couplers. All of the above couplers may be polymer couplers.

Specific examples of the couplers are represented by the following general formulas (M-1), (M-2) and (M-3):

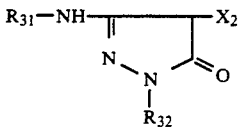

[M-1]

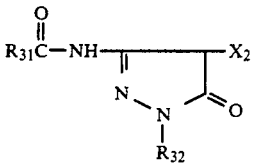

[M-2]

-continued

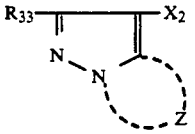

[M-3]

wherein $R_{31}$ represents a 8–32C diffusion-resistant group and $R_{32}$ represents a phenyl or a substituted phenyl group; $R_{33}$ represents a hydrogen atom or a substituent; Z represents a group of nonmetal atoms necessary for forming a 5-membered azole ring containing 2 to 4 nitrogen atoms and substituents (including condensed rings) may be substituted to this azole ring.

$X_2$ represents a hydrogen atom or a group that is capable of eliminating. Details of substituents of $R_{33}$ and the azole ring substitution groups are disclosed in, e.g., column 2 line 41 to column 8 line 27 of the Specification of U.S. Pat. No. 4,540,654.

Within the pyrazoloazole couplers, the imidazo(1,2-b)pyrazoles disclosed in U.S. Pat. No. 4,500,630 are preferred and the pyrazolo(1,5-b)(1,2,4)triazoles disclosed in U.S. Pat. No. 4,540,654 are particularly preferred since there is little yellow side absorption and good light fastness of the coupler dye.

Apart from these couplers, pyrazolotriazole couplers with branched alkyl groups directly connected to the 2, 3 or 6 positions of the pyrazolotriazole ring as disclosed in JP-A-61-65245, pyrazoloazole couplers containing sulfonamido groups in their molecules as disclosed in JP-A-61-65246, pyrazoloazole couplers with alkoxyphenylsulfonamido ballast groups as disclosed in JP-A-61-147254 and pyrazolotriazole couplers with an alkoxy group or aryloxy group in the 6 position as disclosed in European Patent (Laid-open) 226,849 are suitable for use.

Specific examples of these couplers are as follows.

| Compound | $R_{33}$ | $R_{34}$ | $X_2$ |
|---|---|---|---|
| | | 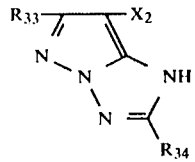 | |
| M'-1 | $CH_3$— | 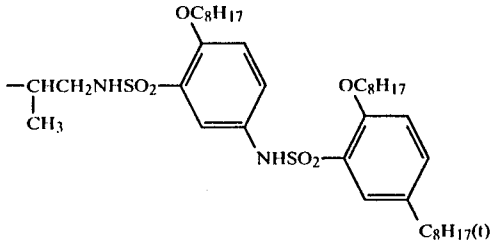 | Cl |
| M'-2 | $CH_3$— | 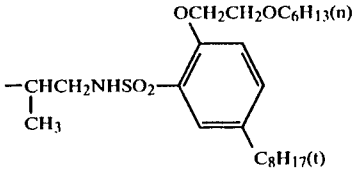 | Cl |
| M'-3 | $CH_3$— | 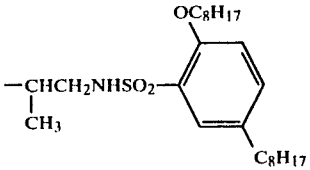 | 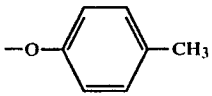 |
| M'-4 | 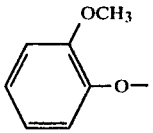 | 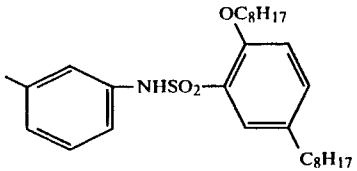 | 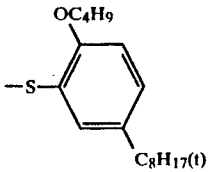 |

-continued
| Compound | $R_{33}$ | $R_{34}$ | $X_2$ |
|---|---|---|---|
| M'-5 | $CH_3$— | 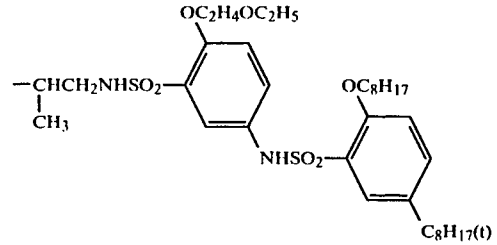 | Cl |
| M'-6 | $CH_3$— | 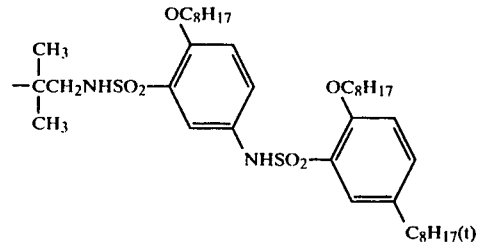 | Cl |
| M'-7 | 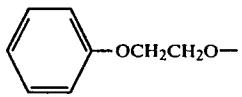 | 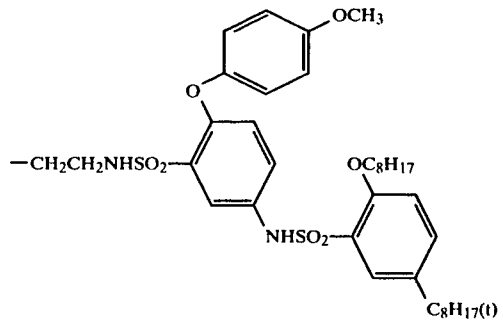 | 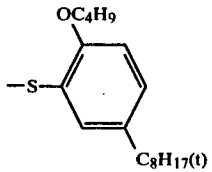 |
| M'-8 | $CH_2CH_2O$— | as above | as above |
| M'-9 | 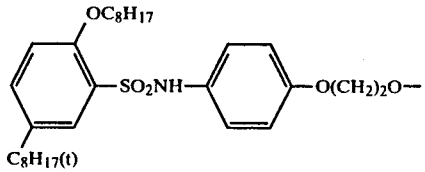 | 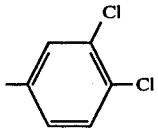 | 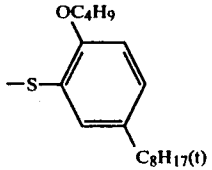 |

-continued
| Compound | $R_{33}$ | $R_{34}$ | $X_2$ |
|---|---|---|---|
| M'-10 | 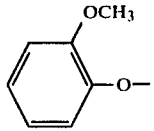 | 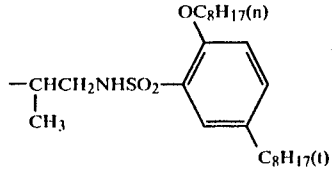 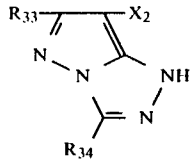 | Cl |
| M'-11 | $CH_3$— | 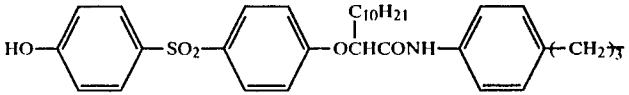 | Cl |
| M'-12 | $CH_3$— | 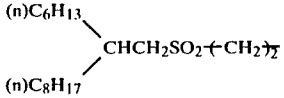 | Cl |
| M'-13 | 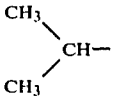 | 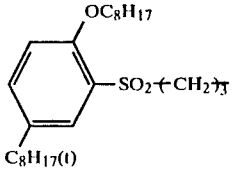 | Cl |
| M'-14 | 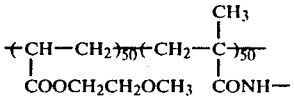 | 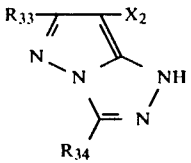 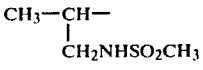 | Cl |

-continued
| Compound | $R_{33}$ | $R_{34}$ | $X_2$ |
|---|---|---|---|
| M'-15 | 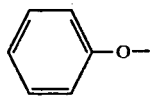 | 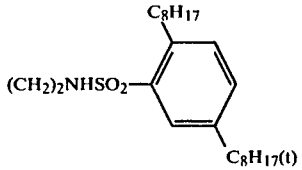 | Cl |
| M'-16 | 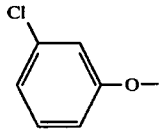 | 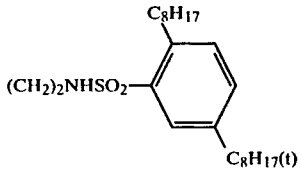 | 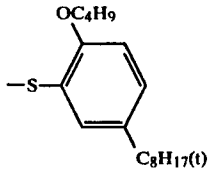 |
(The monomer ratio is shown by weight.)

The most representative cyan couplers are phenolic cyan couplers and naphtholic cyan couplers.

Phenolic cyan couplers comprise the couplers (including the polymer couplers) disclosed in U.S. Pat. Nos. 2,369,929, 4,518,687, 4,511,647 and 3,772,002 which have an acylamino group in the 2 position and an alkyl group in the 5 position of a phenol nucleus. Representative specific examples of these couplers include the coupler of Example 2 disclosed in Canadian Patent 625,822, Compound (1) disclosed in U.S. Pat. No. 3,772,002, Compounds (I-4) and (I-5) disclosed in U.S. Pat. No. 4,564,590, Compounds (1), (2), (3) and (24) disclosed in JP-A-61-39045 and Compound (C-2) disclosed in JP-A-62-70846.

Phenolic cyan couplers also include the 2,5-diacylaminophenolic couplers disclosed in U.S. Pat. Nos. 2,772,162, 2,895,826, 4,334,011 and 4,500,653 and JP-A-59-164555 and representative specific examples of these couplers include Compound (V) disclosed in U.S. Pat. No. 2,895,826, Compound (17) disclosed in U.S. Pat. No. 4,557,999, Compounds (2) and (12) disclosed in U.S. Pat. No. 4,565,777, Compound (4) disclosed in U.S. Pat. No. 4,124,396 and Compound (I-19) disclosed in U.S. Pat. No. 4,613,564.

Additional examples of phenolic cyan couplers include those couplers disclosed in U.S. Pat. Nos. 4,327,173, 4,564,586 and 4,430,423, JP-A-62-257158 and JP-A-62-257158 in which the nitrogen-containing heterocyclic rings are fused to phenol nuclei. Representative specific examples of these couplers that may be cited include Couplers (1) and (3) disclosed in U.S. Pat. No. 4,327,173, Compounds (3) and (16) disclosed in U.S. Pat. No. 4,564,586, Compounds (1) and (3) disclosed in U.S. Pat. No. 4,430,423 and the following compounds:

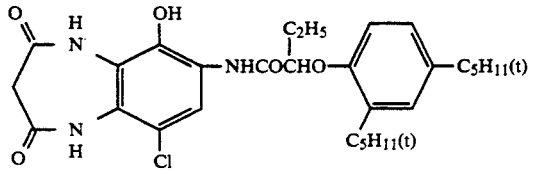

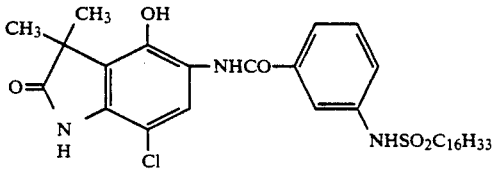

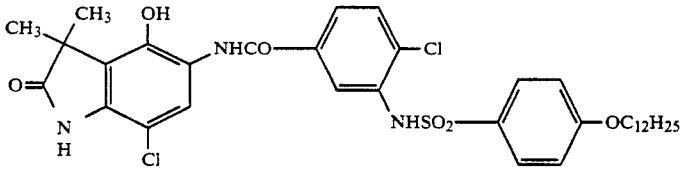

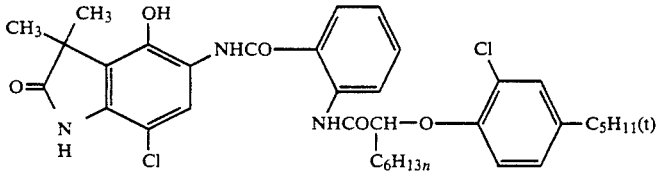

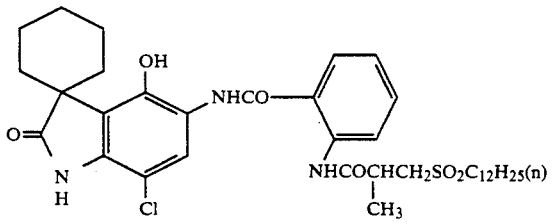

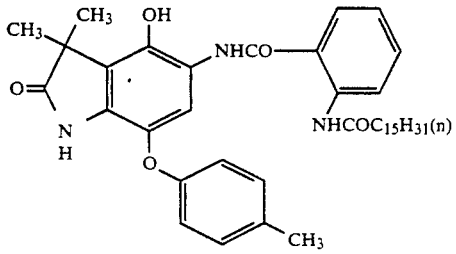

-continued
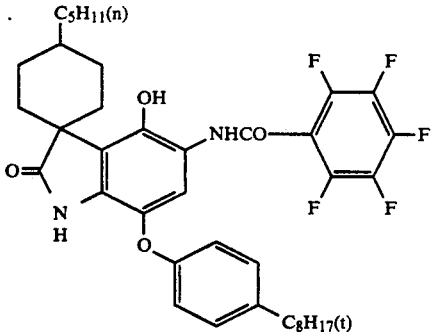
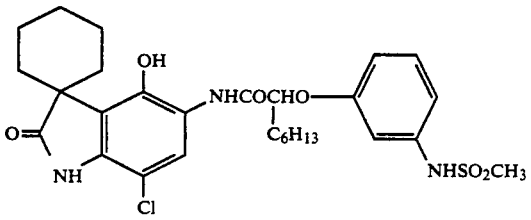
Apart from the abovenoted types of cyan couplers, one may also use, for instance, the diphenylimidazole cyan couplers disclosed in Laid-open European Patent EP0,249,453A2.
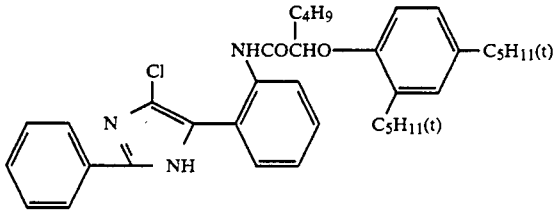
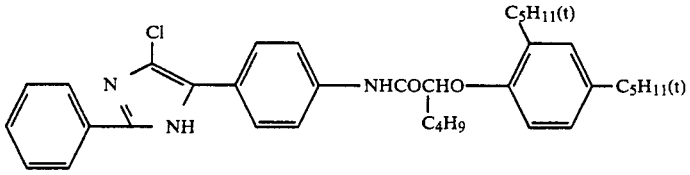
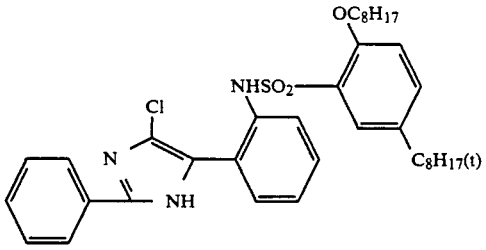
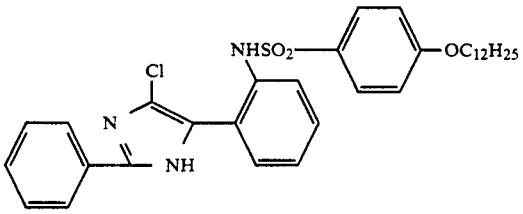

-continued

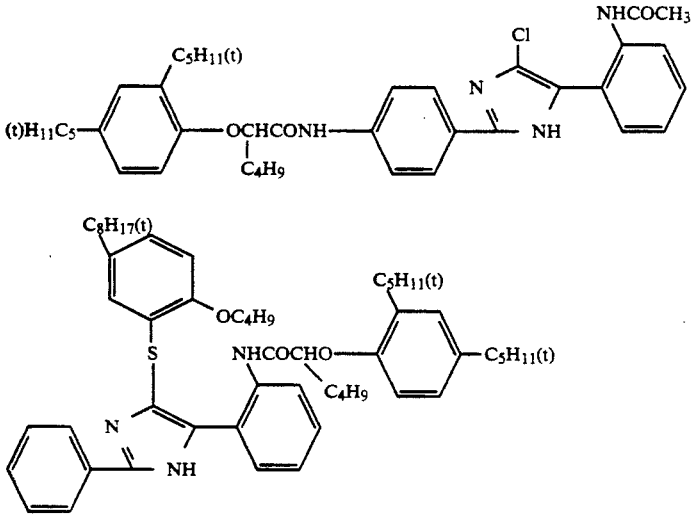

Phenolic cyan couplers further include the ureido couplers disclosed in U.S. Pat. Nos. 4,333,999, 4,451,559, 4,444,872, 4,427,767 and 4,579,813 and European Patent (EP) 067,689B1. Representative specific examples of these couplers that may be cited include Coupler (7) disclosed in U.S. Pat. No. 4,333,999, Coupler (1) disclosed in U.S. Pat. No. 4,451,559, Coupler (14) disclosed in U.S. Pat. No. 4,444,872, Coupler (3) disclosed in U.S. Pat. No. 4,427,767, Couplers (6) and (24) disclosed in U.S. Pat. No. 4,609,619, Couplers (1) and (11) disclosed in U.S. Pat. No. 4,579,813, Couplers (45) and (50) disclosed in European patent (EP) 067,689B1 and Coupler (3) disclosed in JP-A-61-42658.

Naphtholic cyan couplers include couplers which have an N-alkyl-N-arylcarbamoyl group in the 2 position of their naphthol ring (as in, e.g., U.S. Pat. No. 2,313,586), couplers with an alkylcarbamoyl group in the 2 position (as in, e.g., U.S. Pat. No. 2,474,293 and 4,282,312), couplers with an arylcarbamoyl group in the 2 position (as in, e.g., JP-B-50-14523 (the term "JP-B" as used herein means an "examined Japanese patent publication"), couplers with a carbonamido or sulfonamido group in the 5 position (as in, e.g., JP-A-60-237448, JP-A-61-145557 and JP-A-61-153640), couplers with aryloxy elimination groups (as in, e.g., U.S. Pat. No. 3,476,563), couplers with substituted alkoxy elimination groups (as in, e.g., U.S. Pat. No. 4,296,199) and couplers with glycolic acid elimination groups (as in, e.g., JP-B-60-39217).

These couplers can be included in a dispersed emulsion layer in the presence of at least one high boiling point organic solvent. Preferably, high boiling point organic solvents represented by the following formulas (A) to (D) are used:

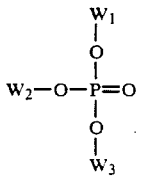

Formula (A)

$W_1—COO—W_2$ Formula (B)

-continued

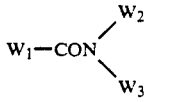

Formula (C)

$W_1—O—W_2$ Formula (D)

In formulas (A) to (D), $W_1$, $W_2$ and $W_3$ each represent substituted or unsubstituted alkyl groups, cycloalkyl groups, alkenyl groups, aryl groups or heterocyclic groups, $W_4$ represents $W_1$, $OW_1$ or $S-W_1$ and n is an integer in the range of 1 to 5. When n is 2 or more, the $W_4$'s may be the same or different and $W_1$ and $W_2$ in general formula (E) may form condensed rings.

Details of these high boiling point organic solvents are disclosed on page 137, lower right-hand column to page 144, upper right-hand column of the Specification of JP-A-62-215272.

The above couplers can also be impregnated in a loadable latex polymer (as in, e.g., U.S. Pat. No. 4,203,716) in the presence or the absence of a high boiling point organic solvent or they may be dissolved in a polymer that is insoluble in water but soluble in an organic solvent and emulsified and dispersed in a hydrophilic colloid.

Preferably, use is made of the homopolymers or copolymers disclosed on page 12 to page 30 of the Specification of Laid-open International Patent WO88/00723, and from the point of view of characteristics such as the stabilization of color images, use of acrylamide polymers is particularly preferred.

Antifoggants in the form of hydroquinone derivatives, aminophenol derivatives, gallic acid derivatives or ascorbic acid derivatives, etc. may be included in the photosensitive material used in the invention.

A variety of color fading preventives may be used in the photographic material of the invention. Representative examples of organic color fading preventives for cyan, magenta and/or yellow images include hydroquinones, 6-hydroxycromans, 5-hydroxycoumarans, spirocromans, hindered phenols, mainly p-alkoxyphenols and bisphenols, gallic acid derivatives, methylenedioxybenzenes, aminophenols, hindered amines and ether or ester derivatives in which the phenolic hydroxyl groups of these various compounds are silylated or alkylated. Metal complexes, etc. such as typified by (bis-salicylaldoximato) nickel complexes and (bis-N,N-dialkyldithiocarbamato) nickel complexes may also be used.

Specific examples of organic color fading preventives are disclosed in the Specifications of the following patents. Hydroquinones are disclosed in, e.g., U.S. Pat. Nos. 2,360,290, 2,418,613, 2,700,453, 2,701,197, 2,728,659, 2,732,300, 2,735,765, 3,982,944 and 4,430,425, UK Patent 1,363,921 and U.S. Pat. Nos. 2,710,801 and 2,816,028; 6-hydrocromans, 5-hydroxycoumarans and spirocromans in e.g., U.S. Pat. Nos. 3,432,300, 3,573,050, 3,574,627, 3,698,909 and 3,764,337 and JP-A-52-152225; spiroindanes in U.S. Pat. No. 4,360,589; p-alkoxyphenols in, e.g., U.S. Pat. No. 2,735,765, UK Patent 2,066,975, JP-A-59-10539 and JP-B-57-19765; hindered phenols in, e.g., U.S. Pat. No. 3,700,455, JP-A-52-72224, U.S. Pat. No. 4,228,235 and JP-B-52-6623; gallic acid derivatives, methylenedioxybenzenes and aminophenols in patents such as U.S. Pat. Nos. 3,457,079 and 4,332,886 and JP-B-56-21144; hindered amines in, e.g., U.S. Pat. Nos. 3,336,135 and 4,268,593, UK Patents 1,326,889, 1,354,313 and 1,410,846, JP-B-51 1420, JP-A-58-114036, JP-A-59-53846 and JP-A-59-78344; phenolic hydroxyl group ether and ester derivatives in, e.g., U.S. Pat. Nos. 4,155,765, 4,174,220, 4,254,216 and 4,264,720, JP-A-54-145530, JP-A-55-6321, JP-A 58-105147 and JP-A-59-10539, JP-B-57-37856, U.S. Pat. No. 4,279,990 and JP-B-53-3263; and, metal complexes in, e.g., U.S. Pat. Nos. 4,050,938 and 4,241,155 and UK Patent 2,027,731(A). The objects can be achieved by the addition to a photosensitive layer after co-emulsification of these various compounds with couplers in amounts that are normally 5 to 100 wt % relative to the color couplers to which they correspond. Deterioration of cyan dye images due to heat and especially due to light can be more effectively prevented by the introduction of an ultraviolet ray absorption agent into the adjacent layers on both sides of the cyan coloring layer.

Particularly preferred color fading preventive agents among the abovenoted color fading preventives include spiroindanes and hindered amines.

Preferably in the invention, the compounds noted below are used together with the abovenoted couplers, especially with the pyrazoloazole couplers.

The use, alone or simultaneously, of compound (F) which bonds chemically with aromatic amine developing agents remaining after color development processing to form a compound that is chemically inert and essentially colorless and/or a compound (G) which bonds chemically with the oxides of the aromatic amine developing agent remaining after color development processing to form a chemically inert and essentially colorless compound is desirable from the point of view of preventing the occurrence of stains and other side effects due, for example, to a reaction between couplers and the residual developing agents or oxides thereof in the film during post-processing storage.

Preferred examples of compound (F) are compounds whose rate constant k2 of the secondary reaction with p-anisidine (in trioctyl phosphate at 80° C.) is in the range of 1.0 l/mol·sec $-1\times10^{-5}$ l/mol·sec.

If k2 is above this range, the compound itself becomes unstable and may decompose through reaction with gelatin and water. On the other hand, if k2 is below the above-mentioned range, the reaction with the residual aromatic amine developing agents is slow. Consequently, there may be failure to achieve the object of the invention which is to prevent side effects from such residual aromatic amine developing agents.

Preferred forms of compound (F) can be represented by the following general formulas (FI) and (FII):

$$R_1-(A)_n-X \quad \text{(FI)}$$

$$R_2-\underset{\underset{B}{|}}{C}=Y \quad \text{(FII)}$$

wherein $R_1$ and $R_2$ are each aliphatic, aromatic or heterocyclic groups; X represents a group which is eliminated by the reaction with an aromatic amine developing agent; A represents a group which forms a chemical bond by the reaction with the aromatic amine developing agent; n is 1 or 0. B is a hydrogen atom or an aliphatic, aromatic, heterocyclic, acyl or sulfonyl group; Y represents a group which accelerates the addition of the aromatic amine developing agent to the compound of general formula (FII); $R_1$ and X may bond together and Y may bond with $R_2$ or B to form ring structures.

Typical modes of chemical bonding with residual aromatic amine developing agents are bonding through a substitution reaction and bonding through an addition reaction.

Specific examples of compounds represented by general formulas (FI) and (FII) are given in JP-A-63-158545, JP-A-62-283338, JP-A-62-158342, and Japanese Patent Application 63-184349.

Details concerning combinations of the above-noted compound (G) and Compound (F) are given in Japanese Patent Application 63-18439.

Among the types of compound (G) which are chemically bonded to the oxidants of aromatic amine developing agents remaining after color development to form a colorless compound which is chemically inert, compounds represented by the following general formula (GI) are more preferred:

$$R-Z \quad \text{(GI)}$$

wherein R is an aliphatic group, an aromatic group or a heterocyclic group; and Z is a nucleophilic group or a group which releases a nucleophilic group in the photographic material. Among the compounds having the formula (GI), there are preferred compounds where Z is a group having a Rearson's nucleophilic $^{n}CH_3I$ value [R. G. Rearson, et al., *J. Am. Chem. Soc.*, 90, 319 (1968)] of 5 or greater or a group derived therefrom.

Examples of the compounds having the formula (GI) are described in European Patent Laid-open No. 255722, JP-A-62-143048, JP-A-62-229145 and Japanese Patent Application Nos. 63-18439, 63-136724, 62-214681 and 62-158342.

Combinations of compounds (D) with compounds (F) are described in more detail in Japanese Patent Application No. 63-18439.

Preferably, amine compounds are used to prevent stain from being formed by colored dye formed by the reaction of couplers with color developing agents remaining during storage after processing or oxidants thereof, or to prevent other side effects from occurring. Among the amine compounds, compounds represented by the following general formula (FG) are preferred:

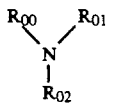

(FG)

In the formula (FG), $R_{00}$ represents a hydrogen atom, a hydroxyl group, an alkoxy group, an acyloxy group, a sulfonyloxy group, a substituted or an unsubstituted amino group, an alkyl group, an aryloxy group, a heterocyclic oxy group, an aliphatic group, an aromatic group or a heterocyclic group; $R_{01}$ represents a hydrogen atom, an aliphatic group, an aromatic group or a heterocyclic group; and $R_{02}$ represents an aliphatic group, an aromatic group or a heterocyclic group. At least two of $R_{00}$, $R_{01}$ and $R_{02}$ may be combined together to form a monocyclic or a polycyclic heterocyclic ring.

Concrete examples of the compounds having the formula (FG) are described in U.S. Pat. Nos. 4,483,918, 4,555,479 and 4,585,728, JP-A-58-102231 and JP-A-59-229557.

The hydrophilic colloid layers of the photographic materials of the present invention may contain ultraviolet light absorbers. Examples of the ultraviolet light absorbers include aryl group-substituted benzotriazole compounds (described in U.S. Pat. No. 3,533,794); 4-thiazolidone compounds (described in U.S. Pat. Nos. 3,314,794 and 3,352,681); benzophenone compounds (described in JP-A-46-2784); cinnamic ester compounds (described in U.S. Pat. Nos. 3,705,805 and 3,707,375); butadiene compounds (described in U.S. Pat. No. 4,045,229); and benzoxcidol compounds (described in U.S. Pat. No. 3,700,455). If desired, ultraviolet light absorbing couplers (e.g., α-naphthol cyan color-forming couplers) and ultraviolet light absorbing polymers may be used. These ultraviolet light absorbers may be incorporated into specific layers.

Hydrophilic colloid layers in the photosensitive material produced by the invention may contain water soluble dyes as filter dyes or for the purpose of blocking irradiation or for a variety of other purposes. Examples of such dyes include oxonol dyes, hemioxonol dyes, styryl dyes, merocyanine dyes, cyanine dyes and azo dyes. Among these dyes, oxonol, hemioxonol and merocyanine dyes are especially useful.

Furthermore, it is advantageous to use gelatin as a binder or as a protective colloid in the emulsion layers of the photographic material of the invention, although hydrophilic colloids other than gelatin may be used alone or together with gelatin.

The gelatin used in the invention may be either lime treated gelatin or gelatin that has been treated with acid. Details of gelatin manufacture are given in "The Macromolecular Chemistry of Gelatin" by Arthur Weiss (Academic Press, 1964).

Nitrocellulose film, or polyethylene terephthalate, or other such transparent film, or a reflecting support such as normally employed for photographic light-sensitive materials may be used as a support in the invention. From the point of view of the objects of the invention, the use of a reflecting support is preferred.

What is meant by a "reflecting support" as used in the invention is a support which increases the reflectivity and thereby makes dye images formed in the silver halide emulsion layers sharper. These supports comprise elements in which a hydrophobic resin containing a dispersed reflecting substance such as titanium oxide, zinc oxide, calcium carbonate or calcium sulfate, etc. is coated on a support and elements in which a hydrophobic resin containing a dispersed reflecting substance is used as a support. There are, for example, supports making the joint use of a reflecting layer, and baryta paper, polyethylene coated paper or polypropylene synthetic paper, and transparent supports making the joint use of reflecting materials, e.g., glass plates, polyethylene terephthalate, cellulose triacetate, cellulose nitrate and similar polyester film, polyamide film, polycarbonate film, polystyrene film and vinyl chloride resin and one may select different supports in accordance with the intended use.

Reflecting materials are suitably materials into which a white pigment has been thoroughly kneaded in the presence of a surfactant. Preferably, use is made of materials in which the surfaces of the pigment grains have been treated with a divalent- tetravalent alcohol.

With regard to the occupied area ratio (%) per unit area defined by the fine white pigment grains, the most representative way of determining this is to divide the area that is under observation into the continuous unit areas of 6 μm×6 μm and measure the ratio (%) ($R_1$) of the projected area of the fine grains in these unit areas. The coefficient of variation of the occupied area ratio (%) can be determined by $s/\overline{R}$ which is the ratio of $R_1$'s standard deviation s to the average value ($\overline{R}$) of $R_1$. The number (n) of unit areas preferably at least 6. The coefficient of variation $s/\overline{R}$ can be determined as follows:

$$\sqrt{\frac{\sum_{i=1}^{n}(R_1-\overline{R})^2}{n-1}} \Big/ \frac{\sum_{i=1}^{n} R_1}{n}$$

In the invention, the coefficient of variation of the fine pigment grains occupied area ratio (%) is preferably 0.15 or less, 0.12 or less being particularly preferred. If this value is 0.08 or less, the dispersion characteristics of the grains are considered to be essentially uniform.

Known primary aromatic amine color developing agents are included in the color developing solutions used in the invention. Preferred examples are p-phenylenediamine derivatives, representative examples of which will now be given although there is no limitation to these agents.

D-1: N,N-Diethyl-p-phenylenediamineD-2: 2-Amino-5-diethylaminotoluene

D-3: 2-Amino-5-(N-ethyl-N-laurylamino)toluene

D-4: 4-(N-Ethyl-N-(8-hydroxyethyl)amino)aniline

D-5: 2-Methyl-4-(N-ethyl-N-(8-hydroxyethyl-)amino)aniline

D-6: 4-Amino-3-methyl-N-ethyl-N-(8-(ethanesulfonamido)ethyl)-aniline

D-7: N-(2-Amino-5-diethylaminophenylethyl)methanesulfonamide

D-8: N,N-Dimethyl-p-phenylenediamine

D-9: 4-Amino-3-methyl-N-ethyl-N-methoxyethyl aniline

D-10: 4-Amino-3-methyl-N-ethyl-N-8-ethoxyethyl aniline

D-11: 4-Amino-3-methyl-N-ethyl-N-8-butoxyethyl aniline

A particularly preferred derivative among these p-phenylenediamine derivatives is compound (D-6), that is, 4-amino-3-methyl-N-ethyl-N-(8-(methanesulfonamido)ethyl)-aniline.

These p-phenylenediamine derivatives may also be in the form of salts such as sulfates, hydrochlorides, sulfites or p-toluenesulfonates, etc. The amount of the primary aromatic amine developing agent preferably used is such an amount as to give a concentration of about 0.1 g to about 20 g or more preferably, about 0.5 g to about 10 g per 1 liter of developing solution.

In the practice of the present invention, it is preferred to use developing solutions containing substantially no benzyl alcohol. The term "containing substantially no benzyl alcohol" as used herein means that the concentration of benzyl alcohol is preferably not higher than 2 ml/l, more preferably not higher than 0.5 ml/l. It is most preferred that no benzyl alcohol is contained in the developing solutions.

Preferably, the developing solutions of the present invention contain substantially no sulfite. This is because sulfite ion functions as a preservative and at the same time, the sulfite ion has an effect of dissolving the silver halide and reacts with the oxidant of the developing solution to thereby reduce the color forming efficiency. It is presumed that an increase in the fluctuation of photographic characteristics in continuous processing is caused by these effects. The term "containing substantially no sulfite ion" as used herein means that the concentration of sulfite ion is preferably not higher than $3.0\times10^{-3}$ mol/l. It is most preferred that no sulfite ion is contained in the developing solutions. In the present invention, there is included a very small amount of sulfite ion which is used to prevent the processing agent kit from being oxidized (the developing agent is concentrated in the processing agent kit before the preparation of the developing solution).

Preferably, the developing solutions of the present invention contain substantially no sulfite ion. It is also preferred that the developing solutions contain substantially no hydroxylamine. This is because hydroxylamine functions as a preservative. Hydroxylamine itself has silver development activity and photographic characteristics are greatly affected by a fluctuation in the concentration of hydroxylamine. The term "containing substantially no hydroxylamine" as used herein means that the concentration of hydroxylamine is preferably not higher than $5.0\times10^{-3}$ mol/l. It is most preferred that no hydroxylamine is contained in the developing solutions.

It is preferred that the developing solutions of the present invention contain organic preservative in place of hydroxylamine and sulfite ion.

The term "organic preservative" as used herein refers to all organic compounds which reduce the deterioration rate of the aromatic primary amine color developing agents when the organic compounds are added to processing solutions for color photographic materials. Namely, they are organic compounds capable of preventing the color developing agents from being oxidized by air. Particularly effective organic preservatives are hydroxylamine derivatives (excluding hydroxylamine, the same applies hereinbelow), hydroxamic acids, hydrazines, hydrazides, phenols, α-hydroxyketones, α-aminoketones, saccharide, monoamines, diamines, polyamines, quaternary ammonium salts, nitroxyl radicals, alcohols, oximes, diamide compounds and condensed cyclic amines. These compounds are described in Japanese Patent Application Nos. 61-147823, 61-173596, 61-165621, 61-188619, 61-197760, 61-186561, 61-198987, 61-201861, 61-186559, 61-170756, 61-188742 and 61-188741, U.S. Pat. Nos. 3,615,503 and 2,494,903, JP-A-52-143020 and JP-B-48-30496 (the term "JP-B" as used herein means an "examined Japanese patent publication").

Substances such as the various metals described in JP-A-57-44148 and JP-A-57-53749, the salicylic acids disclosed in JP-A-59-180588, the alkanolamines disclosed in JP-A-54-3532, the polyethyleneimines disclosed in JP-A-56-94349 and the polyhydroxy compounds disclosed in U.S. Pat. No. 3,746,544 may also be added as other preservatives if required. Addition of an alkanolamine such as triethanolamine, a dialkylhydroxylamine such as diethylhydroxylamine and an aromatic polyhydroxy compound is particularly desirable.

The coating weight (in terms of silver) in the silver halide photographic materials of the present invention is preferably not more than 0.75 g/m$^2$, more preferably not more than 0.65 g/m$^2$, particularly preferably not more than 0.60 g/m$^2$. When the coating weight in terms of silver is more than 0.75 g/m$^2$, photographic characteristics greatly fluctuate during continuous processing and the amount of silver left behind is large. Thus, such large coating weight is not preferred for the purpose of the present invention.

Preferably the color developing solutions of the present invention contain chlorine ion in an amount of $3.5\times10^{-2}$ to $1.5\times10^{-1}$ mol/l, particularly $4\times10^{-2}$ to $1\times10^{-1}$ mol/l. When the concentration of chlorine ion is higher than $1.5\times10^{-1}$ mol/l, development is retarded. Thus, such a high concentration is not preferred for the purposes of conducting rapid development and providing high maximum density. On the other hand, when the concentration is lower than $3.5\times10^{-2}$ mol/l, fogging by pressure is not sufficiently prevented.

Furthermore, it is also preferred that the color developing solutions of the present invention contain bromine ion in an amount of $3.0\times10^{-5}$ to $1.0\times10^{-3}$ mol/l, particularly $5.0\times10^{-5}$ to $5\times10^{-4}$ mol/l. When the concentration of bromine ion is higher than $1\times10^{-3}$ mol/l, the development is retarded and maximum density and sensitivity are lowered, whereas when the concentration is lower than $3.0\times10^{-5}$ mol/l, fogging by pressure is not sufficiently prevented.

Chlorine ion and bromine ion may be added directly to the developing solutions, or they may be dissolved from the photographic materials into the developing solutions during the course of processing.

When chlorine ion is added directly to color developing solutions, examples of chlorine ion donating materials include sodium chloride, potassium chloride, ammonium chloride, lithium chloride, nickel chloride, magnesium chloride, manganese chloride, calcium chloride and cadmium chloride. Among them, sodium chloride and potassium chloride are preferred.

Chlorine ion may be supplied from fluorescent brightener incorporated in the developing solutions.

Examples of bromine ion-donating materials include sodium bromide, potassium bromide, ammonium bromide, lithium bromide, calcium bromide, magnesium bromide, manganese bromide, nickel bromide, cadmium bromide, cerium bromide and thallium bromide. Among them, potassium bromide and sodium bromide are preferred.

When chlorine ion and bromine ion are dissolved from the photographic materials into the developing solutions, chlorine ion and bromine ion may be supplied from emulsions or from other supply sources.

The pH of the color developing solution used in the invention is preferably 9 to 12 and more preferably 9 to 11.0. The solution may also contain other compounds that constitute known developing solution components.

Preferably, use is made of a buffering agent in order to maintain the abovenoted pH. Examples of buffering agents that may be used include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino 2-methyl-1,3-propanediol salts, valine salts, proline salts, trishydroxyaminomethane salts and lycine salts. Carbonates, phosphates, tetraborates, and hydroxybenzoates in particular have the advantages that they possess excellent solubility and buffering capability in the high pH region of 9.0 or more, they have no adverse effects (fogging, etc.) on photographic performance when they are added to color developing solutions and they are low-cost and the use of these buffering agents is therefore especially preferred.

Specific examples of buffering agents that may be cited include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the invention is not limited to these compounds.

The amount of buffering agent added to the color developing solution is preferably 0.1 mol/l or more, and a particularly preferred amount is 0.1 to 0.4 mol/l.

In addition, various chelating agents may be used in the color developing solution such as calcium and magnesium precipitation preventive agents or agents to improve stability of the solution.

Examples of such nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamineorthohydroxyphenylacetic acid, 2-phosphonobutane-1,2,4-tricarboxylic acid, 1-hydroxyethylidene-1,1-diphosphonic acid and N,N'-bis(2-hydroxybenzyl)ethylenediamine-N,N'-diacetic acid.

The joint use of two or more of these chelating agents may be made if required.

A suitable amount of such chelating agents to be added is an amount sufficient to block the metal ions in the color developing solution and the amount is, for example, around 0.1 to 10 g per 1 liter.

Any development accelerator may be added to the color developing solution as required. A typical development accelerator that can be used is benzyl alcohol. However, from the point of view of environmental pollution, the solution preparation characteristics and the prevention of color stains, it is preferable that the color developing solution of the invention contain essentially no benzyl alcohol. What is meant by the phrase "essentially" is that there is no more than 2 ml per 1 liter of developing solution and preferably no benzyl alcohol at all is present. Examples of other development accelerators include the thioether compounds disclosed in JP-B-37-16088, JP-B-37-5987, JP-B-38-7826, JP-B-44-12380 and JP-B-45-9019 and U.S. Pat. No. 3,813,247, etc., the p-phenylenediamine compounds disclosed in JP-A-52-49829 and JP-A-50-15554, the quaternary ammonium salts disclosed in JP-A-50-137726, JP-B-44-30074, JP-A-56-156826 and JP-A-52-43429 etc., the amine compounds disclosed in U.S. Pat. Nos. 2,494,903, 3,128,182, 4,230,796 and 3,253,919, JP-B-41-11431, U.S. Pat. Nos. 2,482,546, 2,596,926 and 3,582,346, etc. and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, etc., in addition to which 1-phenyl-3-pyrazolidones or imidazoles may be added if required.

In the present invention, any antifoggant may be added if required. Examples of antifoggants that can be used include alkali metal halides such as sodium chloride, potassium bromide or potassium iodide and organic antifoggants. Representative examples of organic antifoggants that may be cited include benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, adenine and similar nitrogen-containing heterocyclic compounds.

Brightening agents may be included in the color developing solution that is used in the present invention. 4,4'-diamino-2,2'-disulfostilbene compounds are preferred as brightening agents. The amount to be added is 0 to 5 g/l and preferably 0.1 to 4 g/l.

Also, various surfactants such as alkylsulfonic acids, arylphosphonic acids, aliphatic carboxylic acids and aromatic carboxylic acids may be added if required.

The processing temperature of the color developing solution of the invention is 20° to 50° C. and preferably 30° to 40° C. The processing time is 20 seconds to 5 minutes and preferably 30 seconds to 2 minutes. The amount of replenishment is preferably on the low side and is 20 to 600 ml and preferably 50 to 300 ml per 1 $m^2$ of the photographic material. 60 to 200 ml is even more preferable and 60 to 150 ml is the most preferable amount.

Next, the desilvering process in the invention will be described. Generally, it is satisfactory if a process containing a bleaching step-fixing step, a fixing step-bleach-fixing step, a bleaching step-bleach-fixing step or a bleach-fixing step is used for the desilvering process.

There now follows a description of the bleaching solutions, bleach-fixing solutions and the fixing solutions that are employable in the invention.

Any bleaching agent may used in the bleaching solution or in the bleach-fixing solution of the invention but materials such as organic ferric (III) complex salts (e.g., complex salts of aminopolycarboxylic acids such as ethylenediaminetetraacetic acid, diethylenetriaminepentaacetic acid, aminopolyphosphonic acids, phosphonocarboxylic acids and organic phosphonic acids), organic acids such as citric acid, tartaric acid and malic acid, etc., persulfates and hydrogen peroxide are preferred.

Among these materials, organic ferric(III) complex salts are particularly preferable from the point of view of speed of processing and prevention of environmental pollution. Examples that can be given include aminopolycarboxylic acids, aminopolyphosphonic acids, organic phosphonic acids and salts thereof that are useful for forming organic ferric (III) complex salts are ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diaminetetraacetic acid. These compounds may be in the form of sodium, potassium, lithium or ammonium salts. Among the compounds, ferric (III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are particularly preferred since they have high bleaching power. These ferric ion complex salts, may be used in the form of complex salts or ferric ion complex salts may be formed in solution using a ferric salt, e.g., ferric sulfate, ferric chloride, ferric nitrate, ferric ammoniumsulfate or ferric phosphate, and a chelating agent such as an aminopolycarboxylic acid, aminopolyphosphonic acid or phosphonocarboxylic acid. Also, the chelating agent may be used in an amount that is in excess of the amount needed for forming a ferric ion complex salt. Among iron complexes, aminopolycarboxylic acid iron complexes are preferred and the amount thereof which may be added is preferably 0.01 to 1.0 mol/l and more preferably 0.05 to 0.50 mol/l.

A variety of compounds may be employed as bleaching accelerators in the bleaching solution, bleach-fixing solution or in their prebaths. Materials that are suitable because they have excellent bleaching power are, e.g., the compounds possessing mercapto groups or disulfide bonds that are disclosed in the Specification of U.S. Pat. No. 3,893,858, the Specification of German Patent 1,290,812, JP-A-53-95630 and *Research Disclosure,* Volume 17129 (July 1978) and thiourea compounds and iodine and bromine ions and other halogen compounds disclosed in JP-B-45-8506, JP-A-52-20832, JP-A-53-32735 and U.S. Pat. No. 3,706,561.

In addition, the bleaching solution or bleach-fixing solution used in the invention may also contain a rehalogenation agent such as a bromide (e.g., potassium bromide, sodium bromide, ammonium bromide), a chloride (e.g., potassium chloride, sodium chloride, ammonium chloride) or an iodide (e.g., ammonium iodide). If required, one or more inorganic or organic acids or alkali metal or ammonium salts thereof with pH buffering capabilities such as borax, sodium metaborate, acetic acid, sodium acetate, sodium carbonate, potassium carbonate, phosphorous acid, phosphoric acid, sodium phosphate, citric acid, sodium citrate and tartaric acid and corrosion preventives such as ammonium nitrate and guanidine may be added.

The fixing agents used in the bleach-fixing solution or fixing solution according to the invention are known fixing agents, i.e., water-soluble silver halide solvents such as sodium thiosulfate, ammonium thiosulfate and similar thiosulfates; sodium thiocyanate, ammonium thiocyanate and similar thiocyanates; ethylenebisthioglycolic acid, 3,6-dithia-1,8-octane diol and similar thioether compounds and thioureas. One or a mixture of two or more of these substances may be used. It is also possible to use, for example, special bleach-fixing solutions containing combinations of a large amount of a halide such as potassium iodide and the fixing agents disclosed in JP-A-55-155354. In the invention, the use of thiosulfates, especially ammonium thiosulfate is preferred. The amount of fixing agent per 1 liter is preferably 0.3 to 2 moles and is more preferably in the range of 0.5 to 1.0 mole. The pH region of the bleach-fixing solution or the fixing solution is preferably 3 to 10 and more preferably is 5 to 9.

In addition, various brightening agents, antifoaming agents, surfactants, organic solvents such as methanol, and polyvinylpyrrolidone, etc. may be included in the bleach-fixing solution.

A preservative in the form of a sulfite ion releasing compound such as a sulfite (e.g., sodium sulfite, potassium sulfite, ammonium sulfite), a bisulfite (e.g., ammonium bisulfite, sodium bisulfite, potassium bisulfite) or a metabisulfite (e.g., potassium metabisulfite, sodium metabisulfite, ammonium metabisulfite) may be included in the bleach-fixing solution or fixing solution in the invention. Converted to sulfite ions, the amount of such compounds included is preferably 0.02 to 0.05 mol/l and is more preferably 0.04 to 0.40 mol/l.

Normally, sulfites are added as preservatives but one may also add substances such as ascorbic acid, carbonyl bisulfite adducts and carbonyl compounds.

Further, brightening agents, chelating agents, antifoaming agents and mold preventives may be added if required.

Generally, the silver halide color photographic light-sensitive material of the invention is washed with water and/or given a stabilization treatment after the desilvering treatment comprising fixing or bleachfixing, etc.

The amount of water in the washing stage or step can be set over a wide range depending on the characteristics of the photographic material (which depends on, e.g., the materials used as couplers, etc.), the intended use and a variety of conditions such as the temperature of the washing water, the number of washing tanks (the number of stages) and whether the replenishment system is a counter-flow or a direct flow system, etc. Among these various factors, the relationship between the amount of water and the number of washing tanks in a multistage counter-flow system can be determined by the method described in the Journal of the Society of Motion Picture and Television Engineers, Vol. 64, p. 248 to 253 (May 1955 number). Normally, the number of stages in a multistage counterflow system is preferably 2 to 6, 2 to 4 being particularly preferred.

A multistage counterflow system permits considerable reduction of the amount of washing water, which can be made, for instance, less than 0.5 to 1 liter per 1 $m^2$ of photographic material. However, although the advantages of the invention are very marked there can be problems such as the proliferation of bacteria and adhesion of suspended matter to the photographic material as the in-tank dwell time of the water increases. A very effective measure which can be employed for resolving such problems during processing of the photosensitive material of the invention is the method of reducing calcium and magnesium described in JP-A-62-288838. One can also make use of the isothiazolone compounds and the thiabendazole compounds disclosed in JP-A-57-8542, the chlorinated sodium isocyanurate and other chlorinated bactericides disclosed in JP-A-61-120145, the benzotriazoles described in JP-A-61-267761, copper ions and other bactericides such as described in "Antibacterial, Antimold Chemistry" by Hiroshi Horiguchi, "Microorganism Disinfection, Bactericidal, Antimold Technology" edited by the Eisei Gijutsukai (Hygiane Technology Society) and the "Dictionary of Antibacterial Antimold Agents" edited by the Nihon Bokinbobai Gakkai (Japan Bacteria/Mold Prevention Institute).

The washing water may also contain a surfactant as a draining agent and a chelating agent, typically EDTA, as a hard water softener.

Moreover, it is also possible to effect treatment in a stabilization solution following the washing stage or to effect this treatment without going through a washing stage. A stabilization solution contains compounds having the ability to stabilize the image. Examples of such compounds include aldehydes as typified by formalin, buffering agents for adjusting the pH of the film to a value suitable for dye stabilization and ammonium compounds. It is also possible to use the various abovenoted bactericides and antimold agents in the solution in order to prevent proliferation of bacteria and impart mold resistance to the photosensitive material after processing.

In addition, surfactants, brightening agents and hardeners may also be added. Any known method such as disclosed in, for example, JP-A-57-8543, JP-A-58-14834 and JP-A-60-220345 may be employed if stabilization is effected directly without going through a washing stage in the processing of the photographic material of the invention.

Another suitable procedure is to use 1-hydroxyethylidene-1,1-diphosphonic acid, ethylenediaminetetramethylenephosphonic acid or a similar chelating agent and magnesium or bismuth compounds.

Similarly, a so-called rinse solution may also be used as the stabilization solution or the washing solution that is used after the desilvering treatment in the invention.

The pH in the washing or the stabilization stage in the invention is preferably 4 to 10 and more preferably is 5 to 8. The temperature can be set to a variety of values depending on the intended use and characteristics, etc. of the photographic material but generally it is preferably 15° to 45° C. and more preferably it is 20° to 40° C. The time can be set to any duration but a short duration is desirable from the point of view of reducing the processing time and preferably the time is 15 seconds to 1 minute 45 seconds or more preferably 30 seconds to 1 minute 30 seconds. From the point of view of aspects such as running costs, reduction of the amount of discharged material and handling, the amount of replenishment is preferably kept low.

A specifically preferred replenishment quantity per unit area of the photographic material is 0.5 to 50 times and preferably 3 to 40 times the amount carried in from the prebath, or not more than 1 liter and preferably not more than 500 ml per 1 $m^2$ of the photographic material. Replenishment may be conducted continuously or intermittently.

The solutions used in the washing and/or stabilization stage can also be used in the preceding stage. An example is the reduction of the amount of waste solution by a multistage counterflow system in which reduced washing water overflow is forced to run into the preceding bleach-fixing bath and a supplementary supply of concentrated solution is supplied into this bath.

The total of the desilvering stage and the washing and the stabilization stage times preferably is not more than 2 minutes and more preferably is 30 seconds to 1 minute 30 seconds. What is meant by the total time is the time from when the silver halide color photographic light-sensitive material comes into contact with the first bath in the desilvering stage to when it exits from the last bath of the washing or the stabilization stage and it includes the waste time for intermediate transport.

What is meant by the statement that the sum of the desilvering treatment and the washing and the stabilization treatment times is not more than 2 minutes is that the sum of the times required for the desilvering treatment and the treatment effected up to the drying stage (more specifically the washing and/or stabilizing stage) is not more than 2 minutes. For example, the sum for the processes such as (1) desilvering→Washing
(2) desilvering→stabilization
(3) desilvering→washing stabilization is not more than 2 minutes.

EXAMPLE 1

A silver halide emulsion (1) was prepared in the following manner:

| | |
|---|---|
| Solution 1: | |
| $H_2O$ | 1000 ml |
| NaCl | 3.3 g |
| Gelatin | 32 g |
| Solution 2: | |
| Sulfuric acid (1N) | 24 ml |
| Solution 3: | |
| The following compound A (1% aqueous solution) | 3 ml |

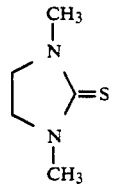

| | |
|---|---|
| Solution 4: | |
| NaCl | 9.9 g |
| KBr | 2.2 g |
| Add $H_2O$ to make | 200 ml |
| Solution 5: | |
| $AgNO_3$ | 32.00 g |
| Add $H_2O$ to make | 200 ml |
| Solution 6: | |
| NaCl | 39.6 g |
| KBr | 9.0 g |
| Add $H_2O$ to make | 560 ml |
| Solution 7: | |
| $AgNO_3$ | 128 g |
| Add $H_2O$ to make | 560 ml |

Solution 1 was heated to 54° C. Solution 2 and solution 3 were added thereto. Subsequently, solution 4 and solution 5 were simultaneously added thereto over a period of 14 minutes. After 10 minutes, solution 6 and solution 7 were simultaneously added thereto over a period of 15 minutes. After 5 minutes, the temperature was lowered and the mixture was desalted.

Water and gelatin for dispersion were added thereto and the pH of the mixture was adjusted to 6.2, thus obtaining a monodisperse cubic silver chlorobromide emulsion having a mean grain size of 0.48 μm and a coefficient of variation (a value s/d obtained by dividing the standard deviation by the mean grain size) of 0.10. Sodium thiosulfate was added to the emulsion at 58° C. and chemical sensitization was suitably carried out so as to give a surface latent image type emulsion.

In the same manner as that described above, emulsions (2) to (9) shown in Table 1 were prepared. Emulsions (5) to (8) were prepared according to the method that before chemical sensitization was conducted in the presence of sodium thiosulfate, $4.0\times10^{-4}$ mol (per mol of silver halide) of the following compound B was added, 1 mol % (based on the amount of silver) of ultrafine silver bromide grain emulsion (having a grain size of 0.05μ) was then added and ripening was carried out at 58° C. for 10 minutes.

It was found by X-ray diffractometry, by the electron microscope and by the EDX method that emulsions (5) to (8) had silver bromide localized phases having a silver bromide content of not higher than 60 mol % in the vicinity of the apexes of the grains.

The addition of metal ion to emulsions (2) to (4) and emulsions (6) to (9) was made by mixing each of potassium hexachloroiridate(III), potassium hexachlororhodate and potassium ferrocyanide in the form of an aqueous solution with solution 6 and adding each solution.

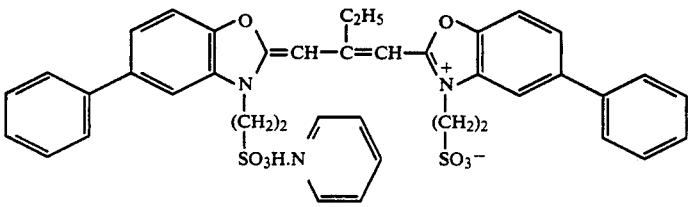

Compound B

TABLE 1

| Emulsion No. | Cl Content (mol %) | Size (μm) | Coefficient of Variation | Metal Ion Species | Amount of Added Metal Ion (mol/mol of Ag) |
|---|---|---|---|---|---|
| 1 | 99 | 0.48 | 0.10 | — | — |
| 2 | 99 | 0.48 | 0.10 | iridium | $5\times10^{-8}$ |
| 3 | 99 | 0.48 | 0.10 | rhodium | $1\times10^{-8}$ |
| 4 | 99 | 0.48 | 0.10 | iron | $1\times10^{-8}$ |
| 5 | 99* | 0.48 | 0.10 | — | — |
| 6 | 99* | 0.48 | 0.10 | iridium | $5\times10^{-8}$ |
| 7 | 99* | 0.48 | 0.10 | rhodium | $1\times10^{-8}$ |
| 8 | 99* | 0.48 | 0.10 | iron | $1\times10^{-8}$ |
| 9 | 99 | 1.01 | 0.10 | iridium | $5\times10^{-8}$ |

*Emulsions had silver bromide localized phases having a silver bromide content of 60 mol % in the vicinity of the apexes of the grains.

Both sides of a paper support were laminated with polyethylene. The surface of the laminated paper support was coated with the emulsions to prepare a multilayer color photographic paper having the following layer structure. The resulting photographic paper was referred to as Sample A. Coating solutions were prepared in the following manner.

Preparation of coating solution for first layer 60.0 g of yellow coupler (ExY) and 28.0 g of anti-fading agent (Cpd-) were dissolved in 150 ml of ethyl acetate, 1.0 ml of solvent (Solv-3) and 3.0 ml of solvent (Solv-4). The resulting solution was added to 450 ml of a 10% aqueous gelating solution containing sodium dodecylbenzenesulfonate and the mixture was dispersed by means of an ultrasonic homogenizer. The resulting dispersion was dissolved in 420 g of emulsion No. 9 of Table 1, which contained the following blue-sensitive sensitizing dye to prepare a coating solution for the first layer. In the same manner as in the preparation of the coating solution for the first layer, coating solutions for the second to the seventh layers were prepared. As the hardener for gelatin, 1,2-bis-(vinylsulfonyl)propane was used for each layer.

The following spectral sensitizing dyes were used.

Blue-sensitive Emulsion Layer:

Anhydro-5,5'-dichloro-3,3'-disulfoethylthiacyanine hydroxide

Green-sensitive Emulsion Layer:

Anhydro-9-ethyl-5,5'-diphenyl-3,3'-disulfoethyloxacarbocyanine hydroxide

Red-sensitive Emulsion Layer:

3,3'-Diethyl-5-methoxy-9,9'-(2,2'-dimethyl-1,3-propano)thiacarbocyanine iodide

The following mixture of A;B;C=7:2:1 by mol was used as a stabilizer for each emulsion layer.

A: 1-(2-Acetamino-phenyl)-5-mercaptotetrazole

B: 1-Phenyl-5 mercaptotetrazole

C: 1-(p-Methoxyphenyl)-5-mercaptotetrazole

The following compounds were used as irradiation-preventing dyes.

[3-Carboxy-5-hydroxy-4-(3-carboxy-5-oxo-1-(2,5-disulfonatophenyl)-2-pyrazoline-4-ylidene)-1-propenyl-1-pyrazolyl]benzene-2,5-disulfonate disodium salt.

N,N-(4,8-Dihydroxy-9,10-dioxo-3,7-disulfonatoanthracene-1,5-diyl)bis(aminomethanesulfonate) tetrasodium salt.

[3-Cyano-5-hydroxy-4-(3-(3-cyano-5-oxo-1-(4-sulfonatohpenyl)-2-pyrazoline-4-ylidene)-1-pentanyl)-1-pyrazolyl]benzene-4-sulfonate sodium salt Layer Structure Each layer had the following composition. Numerals represent coating weight (g/m²). The amounts of silver halide emulsions are represented by coating weight in terms of silver.

Support

Paper support (both sides thereof were laminated with polyethylene)

| | |
|---|---|
| First Layer: Blue-sensitive layer | |
| Silver halide emulsion (No. 9) | 0.29 |
| Gelatin | 1.80 |
| Yellow coupler (ExY) | 0.60 |
| Anti-fading inhibitor (Cpd-1) | 0.28 |
| Solvent (Solv-3) | 0.01 |
| Solvent (Solv-4) | 0.03 |
| Second Layer: Color mixing inhibiting layer | |
| Gelatin | 0.80 |
| Color mixing inhibitor (Cpd-2) | 0.055 |
| Solvent (Solv-1) | 0.03 |
| Solvent (Solv-2) | 0.015 |
| Third Layer: Green-sensitive layer | |
| Silver halide emulsion (No. 1) | 0.305 |
| Gelatin | 1.40 |
| Magenta coupler (ExM) | 0.67 |
| Anti-fading agent (Cpd-3) | 0.23 |
| Anti-fading agent (Cpd-4) | 0.11 |
| Solvent (Solv-1) | 0.20 |
| Solvent (Solv-2) | 0.02 |
| Fourth Layer: Color mixing inhibiting layer | |
| Gelatin | 1.70 |
| Color mixing inhibitor (Cpd-2) | 0.065 |
| Ultraviolet light absorber (UV-1) | 0.45 |
| Ultraviolet light absorber (UV-2) | 0.23 |
| Solvent (Solv-1) | 0.05 |
| Solvent (Solv-2) | 0.05 |
| Fifth Layer: Red-sensitive layer | |

-continued

| | |
|---|---|
| Silver halide emulsion (No. 2) | 0.21 |
| Gelatin | 1.80 |
| Cyan coupler (ExC-1) | 0.26 |
| Cyan coupler (ExC-2) | 0.12 |
| Anti-fading inhibitor (Cpd-1) | 0.20 |
| Color forming accelerator (Cpd-5) | |
| Solvent (Solv-1) | 0.16 |
| Solvent (Solv-2) | 0.09 |
| Sixth Layer: Ultraviolet light absorbing layer | |
| Gelatin | 0.70 |
| Ultraviolet light absorber (UV-1) | 0.26 |
| Ultraviolet light absorber (UV-2) | 0.07 |
| Solvent (Solv-1) | 0.30 |
| Solvent (Solv-2) | 0.09 |
| Seventh Layer: Protective layer | |
| Gelatin | 1.07 |

(ExY) Yellow Coupler
α-Pivalyl-α-(3-benzyl-1-hydantoinyl)-2-chloro-5-[β-(dodecylsulfonyl)butylamido]acetanilide
(ExM) Magenta Coupler
1-(2,4,6-Trichlorophenyl)-3-[2-chloro-5-(3-octadecenylsuccinimido)anilino]-5-pyrazolone
(ExC-1) Cyan Coupler
2-Pentafluorobenzamido-4-chloro-5-[2-(2,4-di-tert-amylphenoxy)-3-methylbutylamidophenol
(ExC-2) Cyan coupler
2,4-Dichloro-3-methyl-6-[α-(2,4-di-tert-amylphenoxy)-butylamido]phenol
(Cpd-1) Anti-fading Agent
2,5-Di-tert-amylphenyl-3,5-di-tert-butylhydroxybenzoate
(Cpd-2) Color Mixing Inhibitor
2,5-Di-tert-octylhydroquinone
(Cpd-3) Anti-fading agent
1,4-Di-tert-amyl-2,5-dioctyloxybenzene
(Cpd-4) Anti-fading Agent
2,2'-Methylenebis(4-methyl-6-tert-butylphenol)
(Cpd-5) Color Forming Accelerator
p-(p-Toluenesulfonamido)-phenyl-dodecane
(UV-1) Ultraviolet Light Absorber
2-(2-Hydroxy-3,5-di-tert-amylphenyl)benzotriazole
(UV-2) Ultraviolet Light Absorber
2-(2-Hydroxy-3,5-di-tert-butylphenyl)benzotriazole
(Solv-1) Solvent
Di(2-ethylhexyl) phthalate
(Solv-2) Solvent
Dibutyl phthalate
(Solv-3) Solvent
Di(iso-nonyl) phthalate
(Solv-4) Solvent
N,N-Diethylcarbonamidomethoxy-2,4-di-t-amylbenzene Further, the emulsions of the first layer, the third layer and the fifth layer were replaced by the emulsions given in Table 2 to prepare Samples B to H. The dry film thickness of each sample was 10 μm and the wet film thickness of each sample was 26 μm.

The magenta coupler in the third layer of each of the samples A to H was replaced by an equimolar amount of the magenta coupler (M-2) of the present invention to prepare Samples A' to H'.

TABLE 2

| Sample No. | Emulsion No. Used for First Layer | Emulsion No. Used for Third Layer | Emulsion No. Used for Fifth Layer |
|---|---|---|---|
| A | 9 | 1 | 2 |
| B | 9 | 2 | 2 |

TABLE 2-continued

| Sample No. | Emulsion No. Used for First Layer | Emulsion No. Used for Third Layer | Emulsion No. Used for Fifth Layer |
|---|---|---|---|
| C | 9 | 3 | 2 |
| D | 9 | 4 | 2 |
| E | 9 | 5 | 2 |
| F | 9 | 6 | 2 |
| G | 9 | 7 | 2 |
| H | 9 | 8 | 2 |

The thus-obtained samples A to H and A' to H' were subjected to gradation exposure for sensitometry through a green filter using a sensitometer (color temperature of light source: 3,200K, FWH type manufactured by Fuji Photo Film Co., Ltd.) Exposure time was 1/50 sec. and 30 sec. and the amount of exposure was adjusted so that both were 250 CMS.

After exposure, the following processing steps which comprises a color development step, bleach-fix step and a rinsing step were carried out.

The above photographic materials were exposed through an optical wedge and processed in the following processing steps.

| Processing Steps | Temperature | Time |
|---|---|---|
| Color development | 35° C. | 45 sec. |
| Bleach-fixing | 30–35° C. | 45 sec. |
| Rinse (1) | 30–35° C. | 20 sec. |
| Rinse (2) | 30–35° C. | 20 sec. |
| Rinse (3) | 30–35° C. | 20 sec. |
| Rinse (4) | 30–35° C. | 30 sec. |
| Drying | 70–80° C. | 60 sec. |

(A four tank countercurrent system of rinse (4)→(1) was used.)

Each processing solution had the following composition:

| | |
|---|---|
| Color Developing Solution | |
| Water | 800 ml |
| Ethylenediamine-N,N,N',N'-tetra methylenephosphonic acid | 1.5 g |
| Triethanolamine | 8 g |
| Sodium chloride | 1.4 g |
| Potassium bromide | 0.004 g |
| Potassium carbonate | 25 g |
| N-Ethyl-N-(β-methanesulfonamido-ethyl)-3-methyl-4-aminoaniline sulfate | 5.0 g |
| N,N-Bis(carboxymethyl)hydrazine | 5.0 g |
| Fluorescent brightener (UVITEX CK, a product of Ciba-Geigy) | 2.0 g |
| Add water to make | 1000 ml |
| pH (25° C.) | 10.10 |
| Bleach-fixing Solution | |
| Water | 400 ml |
| Ammonium thiosulfate (70% aqueous solution) | 100 ml |
| Sodium sulfite | 18 g |
| Ethylenediaminetetraacetic acid iron (III) ammonium | 55 g |
| Disodium ethylenediaminetetraacetate | 3 g |
| Ammonium bromide | 40 g |
| Add water to make | 1000 ml |
| pH (25° C.) | adjusted to 6.0 |

Rinsing Water

Ion exchanged water (each concentration of calcium and magnesium was 2.5 ppm)

The reflection density of the processed samples was measured and the characteristic curve was prepared.

The reciprocal of the exposure amount giving a density 0.5 higher than the fog density was taken as the sensitivity. Sensitivity obtained by exposing sample A immediately after preparation for 30 seconds and then developing it for 45 seconds was referred to as 100. Other sensitivity was represented by a relative value. The change in sensitivity was examined when the exposure time was varied.

In order to examine the resistance to fluctuation in the processing factors, there was taken, as an index of processing dependence, a value obtained by dividing the sensitivity (when the development time in the above color development was 30 seconds) by the sensitivity (when the development time was 90 seconds) and multiplying the quotient by 100. The exposure time was fixed to 30 seconds.

The results are shown in Table 3.

TABLE 3

| | 30 sec. Exposure | | 1/50 sec Exposure | | |
|---|---|---|---|---|---|
| Sample No. | Sensitivity | Processing Stability* | Sensitivity | Processing Stability | Remarks |
| A | 100 | 60 | 48 | 45 | Comp. Ex. |
| B | 110 | 63 | 100 | 51 | " |
| C | 80 | 70 | 90 | 60 | " |
| D | 110 | 71 | 95 | 63 | " |
| E | 150 | 62 | 70 | 49 | " |
| F | 165 | 65 | 155 | 51 | " |
| G | 120 | 71 | 130 | 60 | " |
| H | 160 | 73 | 140 | 62 | " |
| A' | 120 | 72 | 60 | 77 | Invention |
| B' | 130 | 89 | 125 | 88 | " |
| C' | 90 | 85 | 95 | 87 | " |
| D' | 120 | 85 | 110 | 85 | " |
| E' | 165 | 73 | 80 | 74 | Comp. Ex. |
| G' | 180 | 90 | 170 | 89 | Invention |
| H' | 130 | 92 | 140 | 88 | " |
| H' | 180 | 89 | 175 | 86 | " |

*The closer the value of processing stability to 100, the higher is the processing stability.

It is apparent from Table 3 that the photographic materials of the present invention highly highly sensitive over a wide illumination intensity range and have a high processing stability.

EXAMPLE 2

Samples A to H and A' to H' of Example 1 were tested in the same manner as in Example 1 except that the following development processing steps were carried out using the following processing solutions.

It was found that the present invention had similar remarkable effects as in Example 1.

The above photographic materials were exposed through an optical wedge and processed in the following steps:

| Processing Step | Temperature | Time |
|---|---|---|
| Color development | 35° C. | 45 sec. |
| Bleach-fixing | 30–36° C. | 45 sec. |
| Stabilization (1) | 30–37° C. | 20 sec. |
| Stabilization (2) | 30–37° C. | 20 sec. |
| Stabilization (3) | 30–37° C. | 20 sec. |
| Stabilization (4) | 30–37° C. | 30 sec. |
| Drying | 70–85° C. | 60 sec. |

A four tank countercurrent system of stabilization (4)→(1) was used.

Each processing solution had the following composition:

| | |
|---|---|
| Color Developing Solution | |
| Water | 800 ml |
| Ethylenediaminetetraacetic acid | 2.0 g |
| Triethnolamine | 8.0 g |
| Sodium chloride | 1.4 g |
| Potassium bromide | 0.004 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Fluorescent brightener (4,4'-diaminostilbene type) | 2.0 g |
| Add water to make | 1000 ml |
| pH (25° C.) | 10.10 |
| Bleach-fixing Solution | |
| Water | 400 ml |
| Ammonium thiosulfate (70% aqueous solution) | 100 ml |
| Sodium sulfite | 18 g |
| Ethylenediaminetetraacetic acid iron (III) ammonium | 55 g |
| Disodium ethylenediaminetetraacetate | 3 g |
| Glacial acetic acid | 8 g |
| Add water to make | 1000 ml |
| pH (25° C.) | adjusted to 5.5 |
| Stabilizing Solution | |
| Formalin (37% aqueous solution) | 0.1 g |
| Formalin-sulfurous acid adduct | 0.7 g |
| 5-Chloro-2-methyl-4-isothiazoline-3-one | 0.01 g |
| Copper sulfate | 0.005 g |
| Add water to make | 1000 ml |
| pH (25° C.) | adjusted to 4.0 |

EXAMPLE 3

Samples F and F' of Example 1 were subjected to the following test to examine the relationship between bromine ion concentration in the developing solution and fog after processing.

Exposure:

The same way as in Example 1 except that the exposure time was 30 seconds.

Processing:

#1; the same as in Example 2 except that development time was 90 seconds.

#2; the same as in Example 2 except that the color developing solution contained no potassium bromide and the development time was 90 seconds.

The reflection density of the processed samples was measured and the characteristic curve was prepared. The reciprocal of the amount of exposure giving a density higher by 0.5 than the fog density was taken as the sensitivity. The sensitivity obtained by processing sample F by processing #1 was referred to as 100. Other sensitivity was represented by a relative value. The values of fog density and sensitivity are shown in Table 4.

TABLE 4

| Sample No. | Processing | Fog Density | Sensitivity | Remarks |
|---|---|---|---|---|
| F | #1 | 0.02 | 100 | Comp. Ex. |
| F | #2 | 0.03 | 98 | " |
| F' | #1 | 0.005 | 110 | Invention |
| F' | #2 | 0.03 | 107 | Comp. Ex. |

It is apparent from Table 4 that fogging is remarkably decreased when the color photographic material of the present invention is processed by using a color developing solution containing bromine ion in the range of $3\times10^{-5}$ to $1.0\times10^{-3}$ mol/l.

According to the present invention, there can be provided a color photographic material which can be rapidly processed, is highly sensitive and less fogged over a wide exposure range, is not affected very much by fluctuations in development conditions and is of stable quality.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material, comprising at least one silver halide light-sensitive emulsion layer provided on a support wherein at least one of said light-sensitive emulsion layer contains (i) at least one 5-pyrazolone coupler and (ii) at least one monodisperse cubic silver halide emulsion containing at least an iridium ion in an amount from $1\times10^{-9}$ to $1\times10^{-3}$ mol per mol of silver halide, said emulsion being obtained by incorporating said metal ion into silver halide grains in the silver halide light-sensitive emulsion by adding the ion to an emulsion formation system before or during formation of the grains or after formation of the grains but before the addition of a chemical sensitizer; wherein said 5-pyrazole coupler is represented by the following formulas: represented by the following formulas:

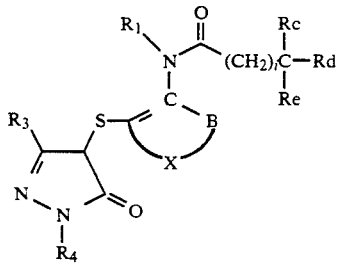

wherein $R^1$ represents a hydrogen atom, an alkyl group, an aryl group or a heterocyclic group; $R_3$ is an anilino group, an acylamino group, a ureido group, a carbamoyl group, an alkoxy group, an allyloxycarbonyl group, an alkoxycarbonyl group or an N-heterocyclic group; $R_4$ is a substituted or unsubstituted aryl group; Rc and Rd each represents halogen atoms or a group selected from the group consisting of Rb and $Z_2Rg$; Re is a hydrogen atom or a group as defined for Rc and Rd; Rb is a substituted or an unsubstituted alkyl, alkyl or heterocyclic group; $Z_2$ represents an oxygen atom or a sulfur atom or NRh; Rf is a hydrogen atom or a group as defined for Rb; Rg is a group defined for Rf; Rh is a group as defined for Rf; Rc may bond with Rd and/or Re to form one or two carbon rings or hetero rings and these may also possess substituents; X represents an atomic group required for the formation of a ring; B represents a carbon atom, an oxygen atom, a nitrogen atom or a sulfur atom; i represents 0 or 1;

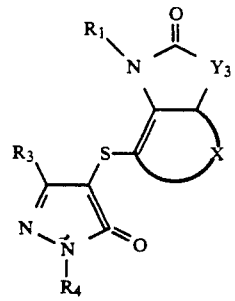

wherein $R_1$, $R_3$, $R_4$ and X signify the same atoms, groups and atomic groups as defined above; $Y_3$ represents a substituent or an unsubstituted methylene or ethylene group or

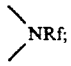

Rf signifies the same atoms and groups as noted as defined above;

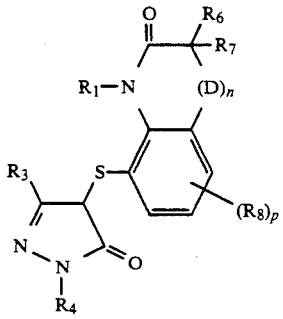

wherein $R_1$, $R_3$ and $R_4$ each signifies the same atoms and groups as defined above; $R_6$ and $R_7$ each represents an alkyl group or an aryl group; $R_8$ reptesents a substituted or unsubstituted methylene group or a substituted or unsubstituted ethylene group; D represents a methylene group or an oxygen, nitrogen or sulfur atom; n represents an integer from 0 to 2 when it is a methylene group and is 1 in the other cases; and p is an integer from 0 to 3.

2. The silver halide color photographic light-sensitive material as in claim 1, wherein the photographic material has a dry film thickness of not more than 15 μm and a wet film thickness from 20 to 40 μm.

3. The silver halide color photographic light sensitive material as in claim 1, wherein said iridium ion is derived from an iridium salt or an iridium complex salt.

4. The silver halide color photographic light-sensitive material as in claim 1, wherein in formula (I), $R_1$ represents a substituted or an unsubstituted aliphatic group having from 1–22 carbon atoms, a substituted or an unsubstituted aryl group selected from the group consisting of a phenyl group and a naphthyl group, and a substituted or an unsubstituted heterocyclic group selected from the group consisting of a 2-furyl group, a 2-thienyl group, a 2-pyrimidinyl group and a 4-pyridyl group.

5. The silver halide color photographic light-sensitive material as in claim 1, wherein the substituents of said substituted groups represented by $R_1$ in said 5-pyrazolone coupler is selected from the group consisting of a halogen atom, an aliphatic group, an aryl group, a heterocyclic group, an alkoxy group, an alkoxy group, an alkylamino group, an alkoxycarbonyl group, a carbamoyl group, an anilino group, a sulfamoyl group, an alkylsulfonyl group, an arylsulfonyl group, an alkylthio group, an arylthio group, an acyl group, an acylamino group, an imido group, a ureido group, a sulfamoylamino group, an alkoxycarbonylamino group, a sulfonamido group, a hydroxyl group and a cyano group.

6. The silver halide color photographic light-sensitive material as in claim 1, wherein said 5-pyrazolone coupler is represented by the following general formula:

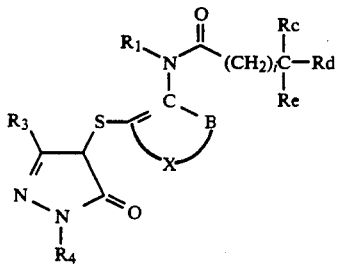

wherein $R_1$, $R_3$, $R_4$, Rc, Rd, Re, X, B and i signify the same atom or groups as defined in claim 1.

7. The silver halide color photographic light-sensitive material as in claim 1, wherein said 5-pyrazolone coupler is represented by the following general formula:

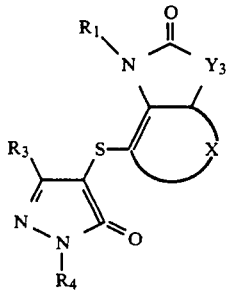

wherein $R_1$, $R_3$, $R_4$ and X signify the same atoms, groups and atomic groups as defined in claim 1; $Y_3$ represents a substituted or an unsubstituted methylene or ethylene group or

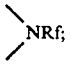

Rf signifies the same atoms and groups as defined in claim 1.

8. The silver halide color photographic light-sensitive material as in claim 1, wherein said 5-pyrazolone coupler is represented by the following general formula:

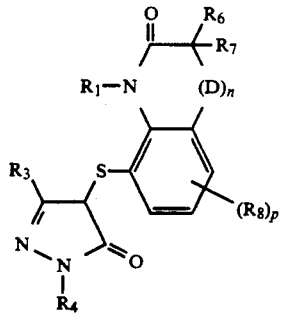

wherein $R_1$, $R_3$ and $R_4$ each signifies the same atoms and groups as defined in claim 1; $R_6$ and $R_7$ each represents an alkyl group or an aryl group; $R_8$ represents a substituent for $L_1$ and $L_2$; D represents a methylene group or an oxygen, nitrogen or sulfur atom; n represents an integer from 0 to 2 when it is a methylene group and is 1 in the other cases; and p is an integer from 0 to 3.

9. The silver halide color photographic light sensitive material as in claim 8, wherein $R_8$ is a substituent selected from the group consisting of a halogen atoms, an aliphatic group, an aryl group, a heterocyclic group, an alkoxy group, an aryloxy group, an alkylamino group, an alkoxycarbonyl group, a carbamoyl group, an anilino group, a sulfamoyl group, an alkylsulfonyl group, an arylsulfonyl group, an alkylthio group, an arylthio group, an acyl group, an acylamino group, an imido group, a ureido group, a sulfamoylamino group, an alkoxycarbonylamino group, a sulfonamido group, a hydroxyl group and a cyano group.

10. The silver halide color photographic light-sensitive material as in claim 8, wherein D represents a nitrogen atom which is substituted with hydrogen or with a substituent group.

11. The silver halide color photographic light-sensitive material as in claim 1, wherein said 5-pyrazolone magenta coupler is used in an amount of from $1\times10^{-3}$ to 1 mol per mol of silver halide in the silver halide emulsion.

12. The silver halide color photographic light-sensitive material as in claim 1, wherein said silver halide comprises silver chloride or silver chlorobromide containing at least 90 mol % of silver chloride.

13. The silver halide color photographic light-sensitive material as in claim 1, wherein B is $-CH_2-$, $=CH-$, a substituted $=\overset{|}{C}-$ group, an $-\overset{|}{N}-H$ group, or a substituted $-\overset{|}{N}-$ group.

14. The silver halide color photographic light-sensitive material as in claim 1, wherein B is $=CH-$ or a substituted $-\overset{|}{N}-$ group.

* * * * *